US007138213B2

(12) United States Patent
Itakura et al.

(10) Patent No.: US 7,138,213 B2
(45) **Date of Patent: *Nov. 21, 2006**

(54) CYAN TONER AND METHOD FOR FORMING AN IMAGE

(75) Inventors: Takayuki Itakura, Shizuoka (JP); Yoshinobu Baba, Kanagawa (JP); Yuko Sato, Shizuoka (JP); Nobuyoshi Sugahara, Shizuoka (JP); Kazuo Terauchi, Shizuoka (JP); Takaaki Kotaki, Shizuoka (JP); Hirohide Tanikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 250 days.

This patent is subject to a terminal disclaimer.

(21) Appl. No.: 10/793,965

(22) Filed: Mar. 5, 2004

(65) Prior Publication Data

US 2004/0209178 A1 Oct. 21, 2004

(30) Foreign Application Priority Data

Mar. 7, 2003 (JP) ..... 2003-061827
Nov. 19, 2003 (JP) ..... 2003-389754

(51) Int. Cl.
*G03G 9/09* (2006.01)
*G03G 15/01* (2006.01)

(52) U.S. Cl. ..... 430/45; 430/108.8; 430/109.3; 430/109.4; 430/111.4

(58) Field of Classification Search ..... 430/45, 430/408.8, 109.3, 109.4, 111.4
See application file for complete search history.

(56) References Cited

U.S. PATENT DOCUMENTS

| | | | | |
|---|---|---|---|---|
| 5,149,610 | A | 9/1992 | Kobayashi et al. | 430/106 |
| 5,364,722 | A | 11/1994 | Tanikawa et al. | 430/110 |
| 5,384,224 | A | 1/1995 | Tanikawa et al. | 430/106 |
| 6,013,403 | A | 1/2000 | Ichikawa | 430/97 |
| 6,106,986 | A | 8/2000 | Shirai et al. | 430/106 |
| 6,327,450 | B1 | 12/2001 | Ito | 399/277 |
| 6,498,910 | B1 | 12/2002 | Haneda | 399/51 |
| 6,528,222 | B1 | 3/2003 | Kohtaki et al. | 430/108.21 |
| 2003/0207186 | A1 | 11/2003 | Itakura et al. | 430/45 |
| 2004/0009420 | A1 | 1/2004 | Sugahara et al. | 430/108.1 |
| 2004/0013958 | A1* | 1/2004 | Ayaki et al. | 430/45 |
| 2005/0106481 | A1* | 5/2005 | Ayaki et al. | 430/45 |

FOREIGN PATENT DOCUMENTS

| | | |
|---|---|---|
| EP | 0822458 | 2/1998 |
| JP | 06-67468 | 3/1999 |
| JP | 11-084764 | 3/1999 |
| JP | 2000-231279 | 8/2000 |
| JP | 2000-305339 | 11/2000 |
| JP | 2000-347476 | 12/2000 |
| JP | 2001-254029 | 9/2001 |
| JP | 2001-290319 | 10/2001 |

* cited by examiner

*Primary Examiner*—John L Goodrow
(74) *Attorney, Agent, or Firm*—Fitzpatrick, Cella, Harper & Scinto

(57) ABSTRACT

The present invention provides a cyan toner including: one or plural heat-absorption peaks in a temperature range of 30 to 200° C. in a heat-absorption curve obtained by using a differential scanning calorimeter; a maximal value of a maximum heat-absorption peak temperature in the range of 65 to 150° C.; and a reflectance of 45 to 80% at a wavelength of 500 nm, a reflectance of 5 to 30% at a wavelength of 600 nm, and a brightness L* of 45 to 75, when measured in a powder form by spectroscopic analysis. The present invention thus provides a cyan toner capable of forming an image with reduced graininess and roughness from a low-density region to a high-density region and ensured a sufficient fixing temperature region, and a method for forming an image using the cyan toner.

21 Claims, 11 Drawing Sheets

CYAN TONER AND METHOD FOR FORMING AN IMAGE

BACKGROUND OF THE INVENTION

1. Field of the Invention

The present invention relates to a cyan toner for developing an electrostatic image through a method for forming an image, such as electrophotography and electrostatic printing, a cyan toner for forming toner images through a method for forming an image of a toner jet process, a method for forming an image employing the cyan toner, and a method for forming a full-color image employing the cyan toner. More specifically, the present invention relates to a cyan toner employed in a fixing process in which those toner images are heat-pressure-fixed onto a transfer material such as a print sheet, a method for forming an image employing the cyan toner, and a method for forming a full-color image employing the cyan toner.

2. Description of the Related Art

As an apparatus for forming a color image of an electrophotographic process spreads widely, its application has also prevailed in wide variety, leading to a severe demand on image quality. An extremely fine and faithful reproduction of even fine portions is demanded for a copy or a print of an image, such as general photographs, catalogs, and maps. Along with this demand, a demand toward vividness of color has increased, and an extension of color reproduction range is desired. In particular, a high level of colorfulness, fineness, graininess, etc. equal to or higher than a print quality is demanded for the electrophotographic process as well.

In a recent apparatus for forming an image of an electrophotographic process employing digital image signals, dots of a constant potential form a latent image on a surface of an electrostatic charge image bearing member (for example, photoconductor), and solid portions, halftone portions, and line portions are expressed by changing a dot density. However, a problem tends to occur in that gradation of a toner image corresponding to a ratio of the dot densities of black portions and white portions of the digital latent image cannot be obtained when toner particles fall out of the dot in this method. Further, when enhancing resolution by reducing a dot size to improve the image quality, reproducibility of the latent image formed with minute dots tends to degrade. In addition, the resolution and the gradation of a highlight portion, in particular, degrade, likely resulting in an image lacking in sharpness. Further, irregular dot disarrangement is perceived as graininess and becomes a cause of degrading the image quality of the highlight portion.

A method for forming an image, employing a deep color toner (deep toner) for the solid portion and a toner with lower density (pale toner) for the highlight portion, is proposed for improving the above. JP 11-84764 A and JP 2000-305339 A each disclose methods for forming an image employing a plurality of toners with different densities combined.

Further, JP 2000-347476 A discloses an apparatus for forming an image combining a pale toner having the maximum reflection density of half or less of the maximum reflection density of a deep toner. JP 2000-231279 A discloses an apparatus for forming an image combining a deep toner having an image density of 1.0 or more and a pale toner having an image density below 1.0, when a toner amount of 0.5 mg/cm$^2$ on a transfer material.

Further, JP 2001-290319 A discloses an apparatus for forming an image combining toners with a slope ratio of recording densities of a deep toner and a pale toner between 0.2 and 0.5.

According to studies of the inventors of the present invention, the gradation and the graininess of an image formed applying those conventional technologies may be improved in a low-density region constituting of the pale toner alone. However, an improvement is needed for the graininess in a medium-density region where the deep toner and the pale toner are mixed, and an extension of a color reproduction range is preferred.

For the pale toner, not much was known about an optimum design of hue and density of a colorant for the pale toner and an effect of a kind and an amount of a wax on improvement of the graininess (roughness) of an image in the low-density region and on expansion of a fixing temperature region.

SUMMARY OF THE INVENTION

An object of the present invention is to provide a cyan toner capable of solving problems in the above conventional techniques and a method for forming an image employing the cyan toner.

Another object of the present invention is to provide a cyan toner capable of forming an image with reduced graininess and roughness from a low-density region to a high-density region and ensuring a sufficient fixing temperature range and a method for forming an image employing the cyan toner.

Further, still another object of the present invention is to provide a cyan toner capable of forming a vivid image having a wider color reproduction range and higher transparency on OHP sheets compared to images formed through conventional methods and a method for forming an image employing the cyan toner.

The present invention relates to a cyan toner including cyan toner particles comprising at least a binder resin, a colorant, and a wax, wherein:

the cyan toner has one or plural heat-absorption peaks in a temperature range of 30 to 200° C. in a heat-absorption curve obtained by using a differential scanning calorimeter;

a maximal value of a maximum heat-absorption peak temperature is in the range of 65 to 105° C.; and the cyan toner in a powder form has a reflectance of 45 to 80% at a wavelength of 500 nm, a reflectance of 5 to 30% at a wavelength of 600 nm, and a brightness L* of 45 to 75, measured by spectroscopic analysis.

Further, the present invention relates to a method for forming an image comprising:

forming a first electrostatic charge image on an electrostatic charge image bearing member, forming a first cyan toner image by developing the first electrostatic charge image using a first cyan toner, and transferring the first cyan toner image to a transfer material through or without an intermediate transfer material;

forming a second electrostatic charge image on the electrostatic charge image bearing member, forming a second cyan toner image by developing the second electrostatic charge image using a second cyan toner, and transferring the second cyan toner image to a transfer material through or without an intermediate transfer material; and forming a fixed image on the transfer material by heat-pressure-fixing the first cyan toner image and the second cyan toner image on the transfer material, wherein:

the first cyan toner is one of a pale cyan toner and a deep cyan toner;

the second cyan toner is the other of a pale cyan toner and a deep cyan toner;

the pale cyan toner comprises cyan toner particles comprising at least a binder resin, a colorant, and a wax, wherein: the pale cyan toner has one or plural heat-absorption peaks in a temperature range of 30 to 200° C. in a heat-absorption curve obtained by using a differential scanning calorimeter; a maximal value of a maximum heat-absorption peak temperature is in the range of 65 to 105° C.; and the pale cyan toner has a reflectance of 45 to 80% at a wavelength of 500 nm, a reflectance of 5 to 30% at a wavelength of 600 nm, and a brightness L* of 45 to 75, when measured by using the cyan toner in a powder form by spectroscopic analysis; and the deep cyan toner is a cyan toner having a brightness L* value smaller than that of the pale cyan toner.

Further, a method for forming an image of the present invention comprises:

forming a first electrostatic charge image on an electrostatic charge image bearing member, forming a first toner image by developing the first electrostatic charge image using a first toner selected from the group consisting of a magenta toner, a yellow toner, a pale cyan toner, a deep cyan toner, and a black toner, and transferring the first toner image to a transfer material through or without an intermediate transfer material;

forming a second electrostatic charge image on the electrostatic charge image bearing member, forming a second toner image by developing the second electrostatic charge image using a second toner selected from the group consisting of a magenta toner, a yellow toner, a pale cyan toner, a deep cyan toner, and a black toner, excluding the first toner, and transferring the second toner image to a transfer material through or without an intermediate transfer material;

forming a third electrostatic charge image on the electrostatic charge image bearing member, forming a third toner image by developing the third electrostatic charge image using a third toner selected from the group consisting of a magenta toner, a yellow toner, a pale cyan toner, a deep cyan toner, and a black toner, excluding the first toner and the second toner, and transferring the third toner image to a transfer material through or without an intermediate transfer material;

forming a fourth electrostatic charge image on the electrostatic charge image bearing member, forming a fourth toner image by developing the fourth electrostatic charge image using a fourth toner selected from the group consisting of a magenta toner, a yellow toner, a pale cyan toner, a deep cyan toner, and a black toner, excluding the first to the third toners, and transferring the fourth toner image to a transfer material through or without an intermediate transfer material;

forming a fifth electrostatic charge image on the electrostatic charge image bearing member, forming a fifth toner image by developing the fifth electrostatic charge image using a fifth toner selected from the group consisting of a magenta toner, a yellow toner, a pale cyan toner, a deep cyan toner, and a black toner, excluding the first to the fourth toners, and transferring the fifth toner image to a transfer material through or without an intermediate transfer material; and forming a fixed image on the transfer material by heat-pressure-fixing the magenta toner image, the yellow toner image, the pale cyan toner image, the deep cyan toner image, and the black toner image, which are carried on the transfer material wherein:

the pale cyan toner comprises cyan toner particles comprising at least a binder resin, a colorant, and a wax, wherein: the pale cyan toner has one or plural heat-absorption peaks in a temperature range of 30 to 200° C. in a heat-absorption curve obtained by using a differential scanning calorimeter; a maximal value of a maximum heat-absorption peak temperature is in the range of 65 to 105° C., and the pale cyan toner has a reflectance of 45 to 80% at a wavelength of 500 nm, a reflectance of 5 to 30% at a wavelength of 600 nm, and a brightness L* of 45 to 75, when measured by using the cyan toner in a powder form by spectroscopic analysis; and the deep cyan toner is a cyan toner having a brightness L* value smaller than that of the pale cyan toner.

DETAILED DESCRIPTION OF THE INVENTION

The above objects of the present invention may be achieved by selecting hue and brightness of a cyan toner and various materials used in a balanced manner.

According to the present invention, appropriately defining thermal property measured through differential thermal analysis and spectral and optical properties measured through spectroscopic analysis of a cyan toner comprising cyan toner particles comprising at least a binder resin, a colorant, and a wax enables formation of an image with reduced graininess and roughness from a low-density region to a high-density region and ensuring a sufficient fixing temperature region.

According to the present invention, a vivid image having a wider range of color reproduction and higher transparency on OHP sheets compared to images formed through conventional methods can be formed.

Figure 1:
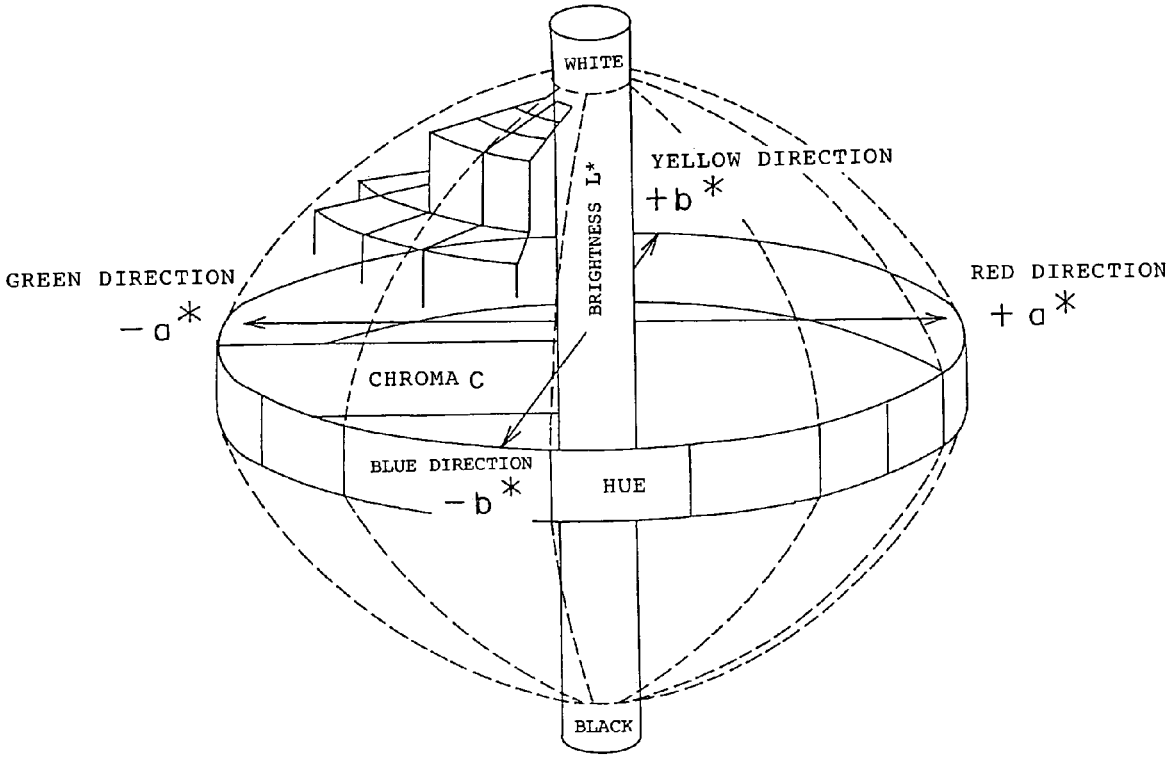
FIG. 1 is a diagram showing a concept of an L*a*b*colorimetric system three-dimensionally.

In general, a*, b*, and L* values of the cyan toner and the image are values used in an L*a*b*colorimetric system, a useful means of expressing color through digitalization. FIG. 1 shows a three-dimensional conceptual diagram of the L*a*b*colorimetric system. In FIG. 1, horizontal axes a* and b* both represent hue. The hue is a barometer of a tone such as red, yellow, green, blue, and violet. A vertical axis L* represents brightness, showing a degree of color brightness comparable irrespective of the hue. Each of the a* and b* axes represents a direction of color, and the a* axis represents a red-green direction and the b* axis represents a yellow-blue direction. Further, the c* value represents chroma, showing a degree of vividness of color, and is determined by the following equation (1), $$c^*=\sqrt{a^{*2}+b^{*2}} \quad \text{(Equation 1)}$$

The cyan toner of the present invention solves the problems described above and provides a good image without graininess particularly in a low-density region, with excellent gradation, and having a wide range of color reproduction. The cyan toner of the present invention exhibits an even better effect as described above when used as a pale toner in combination with a deep toner. In the present invention, a pale toner represents a toner with high brightness and a deep toner represents a toner with low brightness, and they are not necessarily limited to implications of pale color and deep color.

The reason is described below as to why such an effect can be achieved by using the cyan toner having such properties.

In general, a color gamut highly sensitive to the human eye and a color gamut relatively lowly sensitive to the human eye exist in color hue. The colors highly sensitive to the human eye are colors of cold colors from blue to dark blue, and the gradation of those colors is easily recognized even in a high-density region with a small rate of change of the image density. However, the colors have a characteristic in that a variation of dots and lines are easily perceived as graininess (roughness) in a low-density zones where the toner exists as dots and lines in the image. On the other hand, the graininess of the colors of warm colors from yellow to flesh color is hardly recognized by the human eye even in a low-density region with a large rate of change of the image density.

The present invention relates to improvement of graininess in the low-density region of the colors of blue to dark blue, which are relatively highly sensitive to the human eye in all density regions. In the present invention, spectral response distribution of the cyan toner itself in a powder form is measured for investigating the roughness and the graininess of an image upon fixing. The reason is described below for defining spectral response characteristics of the toner in a powder form before being fixing instead of the spectral response characteristics of the image after fixing the toner.

Various fixing devices and transcripts exist, and gloss and the color gamut are changed according to conditions and combinations of the fixing devices and the transcripts. Further, fixing conditions such as pressure, temperature, and a nip width of the fixing device change a state of the crushed toner, and the change influences the graininess (roughness). Those influences appear remarkably in the low-density region. Therefore, defining various spectral response characteristics of the toner in a powder form provides accurate data reflecting the graininess in the toner of the low-density image without influences of a structure of the fixing device and the transcripts.

The present invention can provide an image with little graininess (roughness) and a wide range of color reproduction by controlling kinds, amounts, and dispersion forms of a colorant and a wax, which are added to the toner, and adjusting reflectance at respective wavelengths and brightness within a range defined by the present invention.

Reflectance values at 500 nm and 600 nm in the spectral response distribution is an index of a color gamut zone reproducible by the cyan toner which reproduces blue to dark blue colors. If the reflectance at each wavelength is small, the variation of dots and lines tends to be easily perceived as graininess (roughness). Theoretically, larger reflectance values at wavelengths of 500 nm and 600 nm can provide even wider two-dimensional color reproduction planes. However, a too large value increases a total amount of the cyan toner even if combined with a deep toner, thereby degrading fixability.

Therefore, in the present invention, a cyan toner having the reflectance of the cyan toner in a powder form of 45 to 80% at a wavelength of 500 nm and 5 to 30% at a wavelength of 600 nm, must be used for obtaining a fixed image with little graininess while using a relatively small amount of the cyan toner, particularly in a low-density. With the cyan toner having the reflectance lower than 45% at a wavelength of 500 nm and lower than 5% at a wavelength of 600 nm, the graininess of the image is noticeable in the low-density region where the toner exists as dots and lines in the image. In addition, the gradation of smooth halftone as a photograph is hardly obtained, and image chroma may be degraded. Further, with the cyan toner having the reflectance higher than 80% at a wavelength of 500 nm and higher than 30% at a wavelength of 600 nm, a total amount of the toner used for reproducing relatively high-density halftone in the low-density region becomes large and thus sufficient fixability may not be obtained. The reflectance can be adjusted by controlling: the kind and the thermal property of the wax used for the cyan toner or a mixture (referred to as "wax dispersant") of the wax and a wax dispersion medium used for the cyan toner; the kind and particle diameter distribution of the colorant; and viscoelastic property of the toner.

Controlling the reflectance only with an amount of the colorant added causes an increase in roughness of the fixed image while narrowing a fixing range, degrading the transparency on an OHP sheet, and lowering the chroma of an output image. This is because the dispersion forms of the colorant and the wax in the toner particles are hardly controlled into more preferable forms.

An L* value of the cyan toner measured by using the cyan toners in a powder form is highly sensitive to the human eye similar to a* and b* values. If the L* value is below 45, an effect of reducing the graininess is lowered in the medium-density zone continuing from the low-density region to the high-density region, and a three-dimensional color reproduction space may be degraded in a full-color image. On the other hand, if the L* value is above 75, a total amount of the toner used for reproducing relatively high density halftone in the-low density region becomes too large, and thus, sufficient fixability may not be obtained. The brightness L* of the cyan toner in a powder form can be adjusted by controlling the kind and the thermal property of the wax and the wax dispersant used for the cyan toner and the kind and the particle diameter distribution of the colorant.

Controlling the brightness L* only with an amount of the colorant added causes an increase in roughness of an image while narrowing the fixing range, degrading the transparency on an OHP sheet, and lowering the chroma of an output image. This is because most preferable dispersion forms of the colorant and the wax in the toner particles are hardly obtained.

Combined use of the pale cyan toner having brightness L* of 45 to 75 with the deep cyan toner having brightness L* below 45 measured by using the cyan toners in a powder form is preferable compared to using the pale toner or the deep toner independently. The combination of the toners allows attaining image reproduction without roughness in the low-density region, reproduction of smooth halftone from the low-density region to the high-density region, and satisfactory fixability. In such case, L* (a) which is an L* value of the pale cyan toner and L*(b) which is an L* value of the deep cyan toner preferably satisfy an expression, $10 \leqq L^*(a)-L^*(b) \leqq 30$. If a value of L*(a)–L*(B) is below 10, a three-dimensional color reproduction space may be degraded in a full-color image. On the other hand, if the value of L*(a)–L*(b) is above 30, a total amount of the toner used becomes too large, and thus sufficient fixability may not be obtained, which is not preferable. The brightness L*(b) may be adjusted in the same way of the brightness L*(a) described above.

Defining the spectral properties of the cyan toner in a powder form as described above is a useful means for achieving an image without noticeable graininess in the low-density region, with the gradation of smooth halftone as a photograph, and with satisfactory chroma. Further, a kind and an amount of the wax contained in the cyan toner particles are important for combining high image quality described above with necessary and sufficient fixability.

Next, a more preferable composition of the cyan toner of the present invention will be described.

The cyan toner must contain a wax in addition to a binder resin and a colorant for obtaining an output fixed image with satisfactory chroma and suppressed roughness (graininess) in the low-image density region. In particular, the wax is added into the cyan toner particles when using a heat-pressure-fixing device without any oil application or a heat-pressure-fixing device with minute oil application.

The cyan toner of the present invention has one or plural heat-absorption peaks in a temperature range of 30 to 200° C. in a heat-absorption curve of a differential scanning calorimetry (DSC) and a maximal value of a maximum heat-absorption peak temperature is in the range of 65 to 105° C. Further, the maximal value of the maximum heat-absorption peak temperature of the heat-absorption peaks is more preferably in the range of 70 to 100° C. The maximal value of the maximum heat-absorption peak temperature can be adjusted according to a kind or an amount of the wax used for the cyan toner.

If the maximal value of the maximum heat-absorption peak temperature is below 65° C., the wax tends to melt at a surface of the toner particles when the toner is left in a high temperature environment. Therefore, anti-blocking property may be degraded while the toner may be strongly attached onto the photoconductive drum. Further, if the maximal value of the maximum heat-absorption peak temperature is below 65° C., high temperature anti-offset property may be degraded. On the other hand, if the maximal value of the maximum heat-absorption peak temperature is above 105° C., the wax hardly migrates to the surface of the molten toner particles rapidly when the toner is fixed at low temperature. If the cyan toner having high brightness L* is used for improving the graininess of an image in the low-image density region, a total amount of the cyan toner used increases, thereby easily causing high temperature offset.

When adopting an non-contact fixing system such as oven fixing and flash fixing for a fixing system, a satisfactory fixed image can be obtained with excellent gradation and without graininess (roughness) from the low-image density region to the high-image density region by only suppressing a tone of the cyan toner in a powder form. However, use of the cyan toner of the present invention is extremely important for obtaining a satisfactory fixed image with excellent gradation and without graininess (roughness) when using a contact heat-pressure-fixing system such as a roller or a belt, each of which is a heat-pressure-fixing device without particular oil application or with minute oil application.

Further, when forming continuous full-color images at high speed by combining the pale cyan toner and the deep cyan toner, satisfactory fixing property may be obtained if the following requirements are satisfied regarding not only melting property but also viscoelastic property of the toner.

The preferable elastic property of the cyan toner of the present invention (pale cyan toner) includes elastic modulus ($G'_{120}$) in the range of $5\times10^2$ to $1\times10^5$ Pa stored at 120° C. and elastic modulus ($G'_{180}$) in the range of 10 to $5\times10^3$ Pa stored at 180° C. Further, the elastic modulus ($G'_{120}$) of the cyan toner (pale cyan toner) is preferably in the range of $6\times10^2$ to $9\times10^4$ Pa, and most preferably in the range of $7\times10^2$ to $8\times10^4$ Pa at 120° C. Further, the elastic modulus ($G'_{180}$) of the cyan toner (pale cyan toner) is in the range of preferably 20 to $4\times10^3$ Pa, and most preferably in the range of 30 to $3\times10^3$ Pa stored at a temperature of 180° C.

If the cyan toner has elastic modulus ($G'_{120}$) below $5\times10^2$ Pa, twining of a transfer material to a fixing roller (heating roller) tends to occur when a large amount of the toner must be fixed to the transfer material. Further, if the cyan toner has elastic modulus ($G'_{180}$) below 10 Pa, offset to the fixing roller tends to occur, causing high temperature offset when a large amount of the toner is loaded on the transfer material for fixing.

On the other hand, if the cyan toner has elastic modulus ($G'_{120}$) above $1\times10^5$ Pa, cold offset to the fixing roller tends to occur when fixing temperature is low. When a large amount of the toner is loaded for fixing, heat is not sufficiently transmitted to a lower layer of the toner on the transfer material, causing cold offset at lower temperatures. Further, if the cyan toner has elastic modulus ($G'_{180}$) above $5\times10^3$ Pa, gloss of an image in fixing reduces, and the image quality of the fixed image tends to degrade.

When combining the pale cyan toner and the deep cyan toner of the present invention, the viscoelastic property of the deep toner is preferably in the above range from a view of the high temperature anti-offset property and low temperature fixability (cold anti-offset property).

For adjusting the elastic modulus in the above range, it may be controlled by changing molecular weight of a binder resin or molecular structure such as crosslinked structure of a binder resin.

Further, in the cyan toner of the present invention, a sample of the cyan toner obtained by pressure-molding the toner into pellets has a deformation rate ($R_{200}$) being 45 to 65% measured by compressing at 120° C. and $4.0\times10^3$ Pa. The deformation rate ($R_{200}$) of the toner is more preferably 47 to 63%, and most preferably 48 to 62%. Further, the cyan toner of the present invention has a deformation rate ($R_{500}$) of 65 to 85%, measured by compressing at 120° C. and $1.0\times10^4$ Pa to a sample of the cyan toner in a pellet form. The deformation rate ($R_{500}$) is more preferably 67 to 82%, and most preferably 68 to 81%.

If the deformation rate ($R_{200}$) is far below 45%, a high definition image is hardly obtained because the toner is not crushed while the transfer material with the toner transferred thereto passes through the fixing device, and the toner scatters around the image. In particular, such problem noticeably appears when deepening an image density by loading a large amount of the toner on the transfer material. Further, if the deformation rate ($R_{500}$) is below 65%, gloss tends to become uneven in places using a large amount of the pale cyan toner and using a large amount of the deep cyan toner, when using the toner of the present invention as the pale cyan toner and combining it with the deep cyan toner. Thus, the image quality is easily degraded.

If the deformation rate ($R_{200}$) exceeds 65%, development of an image is obstructed and durability of the cyan toner is degraded because the cyan toner itself is soft, thereby lowering transfer efficiency. Further, if the deformation rate ($R_{500}$) exceeds 85%, the cyan toner is excessively crushed on the transfer material. The fixed image easily blurs when loading a large amount of the toner, and the roughness of the image tends to appear. Adjustment of the deformation rate ($R_{200}$) and the deformation rate ($R_{500}$) of the cyan toner of the present invention in the above range is ascribable to preparation of the cyan toner. To be specific, the cyan toner obtained through pulverization depends on temperature and share during melt-kneading; therefore, the temperature and the share are adjusted. The deformation rate can be adjusted with a molecular weight of a binder resin or an addition of a crosslinking agent.

The cyan toner of the present invention may contain two or more kinds of waxes. The cyan toner of the present invention preferably contains at least a hydrocarbon wax. Adding at least a hydrocarbon wax to the toner particles produces satisfactory affinity between the colorant and the wax. As a result, cyan toner particles with satisfactory transparency on an OHP sheet in the low-image density region and in a form containing a finely dispersed colorant, can be obtained.

Examples of the wax used for the toner of the present invention include: aliphatic hydrocarbon waxes such as a low molecular weight polyethylene wax, a low molecular weight polypropylene wax, an olefin copolymer wax, a microcrystalline wax, a paraffin wax, and a Fischer-Tropsch wax; aliphatic hydrocarbon oxide waxes such as a polyethylene oxide wax; a block copolymer of an aliphatic hydrocarbon wax and an aliphatic hydrocarbon oxide wax; waxes having aliphatic esters as a main component such as a carnauba wax and a montanic ester wax; and aliphatic ester waxes such as a deacidified carnauba wax from which a part of or a whole acidic component was removed.

Further examples of the wax include: straight-chain saturated fatty waxes such as palmitic acid, stearic acid, and montanic acid; unsaturated fatty waxes such as brassidic acid, eleostearic acid, and parinaric acid; saturated alcohol waxes such as stearyl alcohol, aralkyl alcohol, behenyl alcohol, carnaubyl alcohol, ceryl alcohol, and melissyl alcohol; polyalcohol waxes such as sorbitol; fattyamide waxes such as linoleamide, oleamide, and lauramide; saturated fatty bis amide waxes such as methylene bis stearamide, ethylene bis capramide, ethylene bis lauramide, and hexamethylene bis stearamide; unsaturated fatty amide waxes such as ethylene bis oleamide, hexamethylene bis oleamide, N,N'-dioleyl adipamide, and N,N'-dioleyl sebacamide; aromatic bis amide waxes such as m-xylene bis stearamide and N,N'-distearyl isophthalamide; aliphatic metal salts such as calcium stearate, calcium laurate, zinc stearate, and magnesium stearate; graft waxes in which vinyl monomers such as styrene and acrylic acid are grafted to aliphatic hydrocarbon waxes; waxes composed of partially esterified compounds of fatty acids and polyalcohols such as behenic monoglyceride; and waxes composed of methyl ester compounds having hydroxyl groups, obtained by hydrogenation of vegetable fats and oils.

A particularly preferable wax used in the present invention includes aliphatic hydrocarbon waxes. Examples thereof include: low molecular weight olefin polymer waxes produced through radical polymerization of an olefin under high pressure or through polymerization of an olefin under low pressure using a Ziegler catalyst or a metallocene catalyst; Fischer-Tropsch waxes synthesized from coal or natural gas; olefin polymer waxes produced through heat decomposition of high molecular weight olefin polymers; and synthetic hydrocarbon waxes produced from distillation residues of hydrocarbon compounds, obtained through Arge process from synthesis gas containing carbon monoxide and hydrogen, or through hydrogenation of the distillation residues. Further, waxes more preferably used are waxes obtained after purifying hydrocarbon waxes through sweating process, solvent method, use of vacuum distillation, and fractional crystallization.

Examples of hydrocarbons as components of the hydrocarbon waxes include: hydrocarbons synthesized through a reaction of carbon monoxide and hydrogen using metal oxide catalysts (usually a catalyst of multiple systems with two or more kinds of species), such as hydrocarbon compounds synthesized through synthol process and hydrocol using a fluid catalyst bed; hydrocarbons having up to several hundred carbon atoms produced through the Arge process (using a fixed catalyst bed) providing a product rich in waxy hydrocarbons; hydrocarbons produced through polymerization of alkylenes such as ethylene in the presence of a Ziegler catalyst; and paraffin waxes. Those hydrocarbons are preferably used for waxes as they have few and small branches and are long straight-chain saturated hydrocarbons. Waxes synthesized not through polymerization of alkylenes are particularly preferable for molecular weight distribution thereof.

It is preferable that a production step of the cyan toner for full-color image formation includes a first kneading step (masterbatch process) for forming a colorant composition having a finely dispersed colorant and a second kneading step for kneading the first kneaded product and other materials containing a wax. In the present invention, the wax may be simultaneously added with a binder resin and other materials in the second kneading step. However, a wax dispersant is preferably used for finely dispersing the colorant in the toner particles well and eliminating the graininess of an image in the low-image density region.

A wax dispersant contains a wax dispersed in a wax dispersion medium and has enhanced dispersibility of the wax in the binder resin.

The wax dispersion medium is a reaction product of a polyolefin wax and a vinyl polymer and is preferably a grafted product containing a polyolefin wax grafted with a vinyl polymer. Further, a "masterbatch of wax dispersant" form, produced by melting and mixing the obtained wax dispersant with the binder resin at a suitable ratio in advance, is more preferable for improving the dispersion of the colorant in the second kneading step.

Examples of vinyl monomers that can be used for producing the vinyl polymer constituting the wax dispersion medium include: styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and acrylate or methacrylate derivatives such as acrylonitrile, methacrylonitrile, and acrylamide. Those may be used independently, or in combination.

Further, the vinyl monomers include monomers having carboxyl groups. Examples thereof include: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic acid esters such as dimethyl maleate and dimethyl fumarate; α, β-unsaturated acids such as acrylic acid, methacrylic acid, crotonic acid, and cinnamic acid; α, β-unsaturated acid anhydrides such as crotonic anhydride and cinnamic anhydride and anhydrides of the above α, β-unsaturated acids and lower fatty acids; alkenylmalonic acid; alkenylglutaric acid; and alkenyladipic acid.

Further, examples of the vinyl monomers include: acrylates or methacrylates having hydroxyl groups, such as 2-hydroxyethyl acrylate, 2-hydroxyethyl methacrylate, and 2-hydroxypropyl methacrylate; and styrene monomers having hydroxyl groups such, as 4-(1-hydroxy-1-methylbutyl) styrene and 4-(1-hydroxy-1-methylhexyl)styrene.

In particular, examples of a preferable copolymer include: a copolymer of styrene and a nitrogen-containing monomer; a copolymer of styrene and a vinyl monomer having a carboxyl group; and a ternary copolymer of styrene, a nitrogen-containing monomer, and a vinyl monomer having a carboxyl group.

The polyolefin wax to be reacted with the vinyl polymer preferably has the maximal value of the maximum heat-absorption peak temperature of 80 to 140° C. during a temperature increase on a heat-absorption curve measured by differential scanning calorimetry (DSC).

If the maximal value of the maximum heat-absorption peak temperature of the polyolefin is below 80° C. or above 140° C., a branched structure (graft) with the copolymer synthesized using a vinyl monomer is lost. Therefore, the hydrocarbon wax is hardly dispersed finely and segregation of the hydrocarbon wax easily occurs during production of the toner particles, possibly resulting in an image failure such as void. Examples of the polyolefin wax include a polyethylene wax and an ethylene-propylene copolymer wax. In particular, a polyethylene with low-density wax is most preferably used for improving reaction efficiency.

In case of using the polyethylene wax with low-density for the polyolefin wax, a graft polymer of polyethylene and a vinyl polymer can be produced, for example, by melting the polyethylene wax with low-density in xylene and adding a vinyl monomer to a xylene solution of the polyethylene with low-density under heating for a reaction.

The wax dispersion medium containing at least a reaction product of a vinyl polymer synthesized from a vinyl monomer, and polyolefin preferably has a weight average molecular weight (Mw) of 5,000 to 100,000, and a number average molecular weight (Mn) of 1,500 to 15,000 according to molecular weight distribution measured by gel permeation chromatography (GPC) A ratio (Mw/Mn) of the weight average molecular weight (Mw) to the number average molecular weight (Mn) is preferably 2 to 40.

If the weight average molecular weight (Mw) of the wax dispersion medium is below 5,000, the number average molecular weight (Mn) of the wax dispersion medium is below 1,500, or the ratio (Mw/Mn) of the weight average molecular weight (Mw) to the number average molecular weight (Mn) is below 2, the anti-blocking property of the toner may be degraded.

If the weight average molecular weight (Mw) of the wax dispersion medium is above 100,000, the number average molecular weight (Mn) of the wax dispersion medium is above 15,000, or the ratio (Mw/Mn) of the weight average molecular weight (Mw) to the number average molecular weight (Mn) is above 40, the wax finely dispersed in the wax dispersion medium hardly migrates to the surface of the toner particles rapidly during heat fixing, thereby not exhibiting a sufficient effect of the wax.

The colorant in the cyan toner particles according to the present invention preferably contains 70% by number of colorant particles having particle diameters of 0.05 to 0.5 μm.

When discussing a dispersion particle diameter of the colorant, the average particle diameter was regarded as important. However, dispersion particle diameter distribution of the colorant particles dispersed in the cyan toner particles is extremely important for improving the color reproduction. To be more specific, even if the average particle diameter is small, when a broad dispersion particle diameter distribution tends to result in a large difference in a dispersion level of the colorant between the toner particles. In addition, a broad dispersion particle diameter distribution tends to result in irregular light reflections caused by relatively large colorant particles which are not sufficiently dispersed. Thus, satisfactory color reproduction is hardly obtained. In particular, a cyan toner having sharp dispersion particle diameter distribution of the colorant particles dispersed in the cyan toner, is preferably used for reducing the roughness in the low-image density region using the pale cyan toner.

The colorant particles having very small particle diameters below 0.05 μm are basically perceived to not adversely affect reflection and absorption properties of light. Those particles contribute to satisfactory transparency on an OHP sheet, but coloring power degrades because of a too small dispersion particle diameter, thereby possibly degrading the chroma. On the other hand, if many colorant particles having particle diameters above 0.5 μm exist, the brightness and the vividness of a projected image maybe degraded. The colorant preferably contains 70% or more by number, preferably 75% by number, and more preferably 80% by number of the colorant particles having particle diameters of 0.05 to 0.5 μm according to the present invention. The % by number of the colorant particles dispersed in the cyan toner particles can be adjusted through the first kneading step (masterbatch process) and/or the second kneading step.

According to the present invention, examples of a cyan colorant of that can be used for the pale cyan toner and the deep cyan toner having an L* value smaller than that of the pale cyan toner include a copper phthalocyanine compound and derivatives thereof, an anthraquinone compound, and a basic dye lake compound. Specific examples of the cyan colorant include C.I. Pigment Blue 1, 7, 15, 15:1, 15:2, 15:3, 15:4, 60, 62, and 66. Those may be used independently or in combination. In particular, a green colorant is preferably used together with the C.I. Pigment Blue 15:3 as a base. Using C.I. Pigment Green 7 together with the C.I. Pigment Blue 15:3 as a base is preferable because the color reproduction of blue to green regions highly sensitive to the human eye, in particular, becomes satisfactory. Those colorants and the following yellow colorants, magenta colorants, or the like may be mixed to adjust the a*, b*, and L* values of the cyan toner.

The colorant is selected in terms of hue angle, the chroma, the brightness, weatherability, the transparency on an OHP, and the dispersibility in the toner particles. The colorant in the pale cyan toner of the present invention is preferably added in 0.2 to 1.2 parts by mass with respect to 100 parts by mass of a resin. Adjusting spectral values, which are measured spectral distribution properties of the cyan toner in a powder form, to be within the range of the present invention by selecting the kinds and the amounts of the colorant and the wax used enable formation of an image with satisfactory graininess and without roughness in the low-density region.

The deep cyan toner is preferably used in 2.0 to 8.0 parts by mass with respect to 100 parts by mass of the resin. If the amount of the colorant is below 2.0 parts by mass in the deep cyan toner, difference of role of the deep cyan toner from the pale cyan toner becomes obscure. Therefore, the amount of the toner loaded becomes excessive when reproducing the high-image density region, possibly invoking fixing failure. Further, if the amount exceeds 8.0 parts by mass, the dispersibility of the colorant degrades, possibly arousing a problem such as inferior transparency on an OHP sheet.

Various resins known as a binder resin for conventional electrophotography may be used for the binder resin of the present invention. Of those, a preferable binder resin contains a resin as a main component selected from the group consisting of (a) a polyester resin, (b) a hybrid resin containing a polyester unit and a vinyl copolymer unit, (c) a mixture of a hybrid resin and a vinyl copolymer, (d) a mixture of a hybrid resin and a polyester resin, (e) a mixture of a polyester resin and a vinyl copolymer, and (f) a mixture of a polyester resin, a hybrid resin containing a polyester unit and a vinyl copolymer unit, and a vinyl copolymer. According to the present invention, "main component" refers to a component accounting for 50% by mass or more of the binder resin.

Polyalcohols, polycarboxylic acids, polycarboxylic acid anhydrides, and polycarboxylates can be used as raw material monomers when using polyester resins for the binder resin. Examples of a dihydric alcohol component include: alkylene oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and a hydrogenated bisphenol A.

Examples of a trihydric or more alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a polycarboxylic acid component include: aromatic dicarboxylic acids and anhydrides thereof, such as phthalic acid, isophthalic acid, and terephthalic acid; alkyl dicarboxylic acids and anhydrides thereof, such as succinic acid, adipic acid, sebacic acid, and azelaic acid; succinic acids substituted by an alkyl group having 6 to 12 carbon atoms and anhydrides thereof; unsaturated dicarboxylic acids such as fumaric acid, maleic acid, and citraconic acid, and anhydrides thereof; n-dodecenylsuccinic acid; and isododecenylsuccinic acid.

The polyester resin, which is produced through condensation polymerization of a bisphenol derivative represented by the following general formula (1) as a diol component and a carboxylic acid component, composed of dihydric carboxylic acid, acid anhydride thereof, or lower alkyl ester thereof (such as fumaric acid, maleic acid, maleic acid anhydride, phthalic acid, and/or terephthalic acid) as an acid component, is particularly preferably used for a color toner because of satisfactory charging property.

General formula (1)

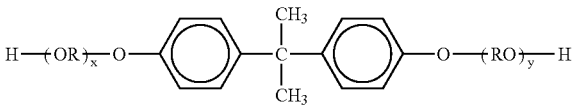

(wherein, R represents an ethylene group or a propylene group, x and y are integers of 1 or more respectively, and an average of x+y is 2 to 10)

Further, examples of a polyvalent carboxylic acid component having three or more carboxyl groups include 1,2,4-benzene tricarboxylic acid, 1,2,5-benzene tricarboxylic acid, 1,2,4-naphthalene tricarboxylic acid, 2,5,7-naphthalene tricarboxylic acid, 1,2,4,5-benzene tetracarboxylic acid, anhydrides thereof, and ester compounds thereof.

The polyvalent carboxylic acid component having three or more carboxyl groups is preferably used in an amount of 0.1 to 1.9 mol % with respect to the total monomer.

Further, using a hybrid resin containing a polyester unit which is a condensation polymer of polyalcohol and polybasic acid and contains an ester bond in a main chain, and a vinyl copolymer unit which is a polymer having an unsaturated hydrocarbon group, as a binder resin can provide further improved dispersibility of the wax, the low temperature fixability, and the anti-offset property. The hybrid resin used in the present invention refers to a resin with a vinyl copolymer unit and a polyester unit chemically bonded. Specifically, the hybrid resin is a resin formed through an ester exchange reaction of a polyester unit and a vinyl copolymer unit produced by polymerizing a monomer having a carboxylate group, such as (meth)acrylates. Preferably, the hybrid resin is a graft copolymer or a block copolymer containing a vinyl copolymer as a backbone polymer and a polyester unit as a branch polymer.

Examples of the vinyl monomers for forming vinyl copolymers include: styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Examples thereof further include: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic acid esters such as dimethyl maleate and dimethyl fumarate; α, β-unsaturated acids such as acrylic acid, methacrylic acid, crotonic acid, and cinnamic acid; α, β-unsaturated acid anhydrides such as crotonic anhydride and cinnamic anhydride and anhydrides of the above α, β-unsaturated acids and lower fatty acids; and monomers having carboxyl groups, such as alkenylmalonic acid, alkenylglutaric acid, and alkenyladipic acid.

Further, examples of the vinyl monomers include: acrylates or methacrylates such as 2-hydroxyethyl acrylate, 2-hydroxyethyl methacrylate, and 2-hydroxypropyl methacrylate; and monomers having hydroxy groups, such as 4-(1-hydroxy-1-methylbutyl)styrene and 4-(1-hydroxy-1-methylhexyl)styrene.

The vinyl copolymer unit of the binder resin according to the present invention may have a crosslinking structure crosslinked with a crosslinking agent having two or more vinyl groups. Examples of the crosslinking agent include: aromatic divinyl compounds such as divinylbenzene and divinylnaphthalene; diacrylate compounds bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate; dimethacrylate compounds-bonded with an alkyl chain, such as ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate; diacrylate compounds bonded with an alkyl chain containing an ether bond, such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate; dimethacrylate compounds bonded with an alkyl chain containing an ether bond, such as diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate; diacrylate compounds such as polyoxyethylene (2)-2, 2-bis (4-hydroxyphenyl)propane diacrylate and polyoxyethylene(4)-2,2-bis(4-hydroxyphenyl)propane diacrylate; and dimethacrylate compounds such as polyoxyethylene(2)-2,2-bis(4-hydroxyphenyl)propane dimethacrylate and polyoxyethylene(4)-2,2-bis(4-hydroxyphenyl)propane dimethacrylate.

Examples of a polyfunctional crosslinking agent include: pentaerythritol triacrylate, trimethylolethane triacrylate, trimethylolpropane triacrylate, tetramethylolmethane tetraacrylate, and oligoester acrylate; pentaerythritol trimethacrylate, trimethylolethane trimethacrylate, trimethylolpropane trimethacrylate, tetramethylolmethane tetramethacrylate, and oligoester methacrylate; and triallyl cyanurate and triallyl trimellitate.

The hybrid resin used in the present invention preferably contains a monomer component which may react with both resin components in one of a vinyl copolymer unit and a polyester unit or in both units. Among the monomers constituting the polyester unit, examples of the monomers which may react with the vinyl copolymer unit include: unsaturated dicarboxylic acids such as phthalic acid, maleic acid, citraconic acid, and itaconic acid; and anhydrides thereof. Among the monomers constituting the vinyl copolymer unit, examples of the monomers which may react with the polyester unit include monomers having carboxylic groups or hydroxyl groups, acrylates, and methacrylates.

A method for obtaining a reaction product of the vinyl copolymer unit and the polyester unit preferably involves a method of polymerizing one or both resins in the presence of a polymer containing a monomer component which may react with the respective units.

Examples of a polymerization initiator used in the production of the vinyl copolymer of the present invention include: azo polymerization initiators such as 2,2'-azobisisobutyronitrile, 2,2'-azobis(4-methoxy-2,4-dimethylvaleronitrile), 2,2'-azobis(2,4-dimethylvaleronitrile), 2,2'-azobis (2-methylbutyronitrile), dimethyl-2,2'-azobisisobutyrate, 1,1'-azobis(1-cyclohexanecarbonitrile), 2-(carbamoylazo) isobutyronitrile, 2,2'-azobis(2,4,4-trimethylpentane), 2-phenylazo-2,4-dimethyl-4-methoxyvaleronitrile, and 2,2'-azobis(2-methylpropane); ketone peroxides polymerization initiators such as methyl ethyl ketone peroxide, acetylacetone peroxide, and cyclohexanone peroxide; and peroxide polymerization initiators such as 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α, α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl)peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amylperoxy-2-ethylhexanoate, di-t-butyl peroxyhexahydroterephthalate, and di-t-butyl peroxyazelate.

Examples of a production method for preparing the hybrid resin used for the toner of the present invention include the following production methods (1) to (5).

(1) A method comprising the steps of producing the vinyl copolymer and the polyester resin separately, melting and swelling them in a small amount of an organic solvent, adding an esterification catalyst and alcohol followed by heating to thereby synthesize the hybrid resin through an ester exchange reaction.

(2) A method comprising the steps producing a vinyl copolymer, then producing the polyester unit and a hybrid resin component in the presence of the vinyl copolymer. The hybrid resin component is produced through a reaction of the vinyl copolymer and one of a polyester monomer (alcohol or carboxylic acid) and the polyester resin, or through a reaction of the vinyl copolymer with both the polyester monomer and the polyester resin. The vinyl monomer can be added optionally. An organic solvent can be used as appropriately.

(3) A method comprising the steps of producing a polyester unit, then producing the vinyl copolymer and a hybrid resin component in the presence of the polyester unit. The hybrid resin component is produced through a reaction of the polyester unit and one of the vinyl copolymer and the vinyl monomer, or through a reaction of the polyester unit with both the vinyl copolymer and the vinyl monomer. Polyalcohol and/or polycarboxylic acid can be added optionally.

(4) A method comprising the steps of producing a vinyl copolymer unit and a polyester unit, then producing a hybrid resin component by adding one of the vinyl monomer and the polyester monomer (alcohol or carboxylic acid) or both. An organic solvent can be used as appropriately.

(5) A method comprising the steps of producing the vinyl copolymer unit, the polyester unit, and a hybrid resin component by mixing the vinyl monomer and the polyester monomer (polyalcohol or polycarboxylic acid) for consecutive addition polymerization reaction and condensation polymerization reaction. An organic solvent can be used as appropriately.

Further, after the production of the hybrid resin component through the above production methods (1) to (4), the vinyl copolymer or the polyester resin may be added by adding one of the vinyl monomer and the polyester monomer (polyalcohol or polycarboxylic acid) or both for at least one of addition polymerization reaction and condensation polymerization reaction.

According to the above production methods (1) to (5), multiple polymer units having different molecular weights and degree of crosslinking can be used for the vinyl copolymer unit and the polyester unit.

The binder resin used in the toner of the present invention may be a mixture of the polyester resin and the vinyl copolymer, a mixture of the hybrid resin and the vinyl copolymer, and a mixture of the polyester resin, the hybrid resin, and the vinyl copolymer.

The cyan toner of the present invention may contain a charge control agent. A known charge control agent can be used, but in particular, a metal compound of aromatic carboxylic acid is preferable because it is colorless, allows rapid triboelectrification of the cyan toner, and stably retains a constant charge amount.

Examples of a negative charge control agent include: metal compounds of salicylic acids, naphthoic acids, and dicarboxylic acids; high molecular weight compounds having a sulfonic group or a carboxylic group on a side chain, boron compounds, urea compounds, silicon compounds, and calixarene. In particular, aluminum 3,5-di-tertiarybutylsalicylate is preferable for rapid charging.

Examples of a positive charge control agent include quaternary ammonium salts, high molecular weight compounds having the quaternary ammonium salts on a side chain, guanidine compounds, and imidazole compounds. The charge control agent may be internally or externally added to the toner particles. The charge control agent is added in an amount of 0.5 to 10 parts by mass with respect to 100 parts by mass of the binder resin.

A known fluidity improver can be externally added to the cyan toner particles of the present invention. In particular, external addition of the fluidity improver is preferable from a view point of image quality improvement and storage stability of the toner under a high temperature environment. Examples of the fluidity improver include inorganic fine powders such as silica fine powder, titanium oxide fine powder, and aluminum oxide fine powder. Of those, the silica fine powder is particularly preferable. The inorganic fine powder is preferably subjected to hydrophobic treatment using a hydrophobic treatment agent such as a silane compound, silicone oil, or a mixture thereof.

Examples of the hydrophobic treatment agent include coupling agents such as a silane compound, a titanate coupling agent, an aluminum coupling agent, and a zirconium aluminate coupling agent.

A preferable silane compound is represented by the following general formula (2).

$$R_mSiY_n \qquad \text{(General formula 2)}$$

(wherein, R represents an alkoxy group, m represents an integer of 1 to 3, Y represents a functional group selected from the group consisting of an alkyl group, a vinyl group, a phenyl group, a methacryl group, an amino group, an epoxy group, a mercapto group, and derivatives thereof, and n represents an integer of 1 to 3).

Examples of the silane compound include hexamethyldisilazane, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane. The hydrophobic treatment agent is used in an amount of preferably 1 to 60 parts by mass, and more preferably 3 to 50 parts by mass with respect to 100 parts by mass of the inorganic fine powder before the treatment.

Alkylalkoxysilane represented by the following general formula (3) is a hydrophobic agent particularly preferable for the hydrophobic treatment of the fluidity improver according to the present invention.

$$C_nH_{2n+1}—Si—(OC_mH_{2m+1})_3 \qquad \text{(General formula 3)}$$

(wherein, n represents an integer of 4 to 12, and m represents an integer of 1 to 3)

The alkylalkoxysilane with n smaller than 4 facilitates the hydrophobic treatment, though undesirably resulting in low hydrophobicity. If n is larger than 12, titanium oxide fine powder may greatly coalesce to result in low fluidity imparting ability. If m is larger than 3, the alkylalkoxysilane may become less reactive, inhibiting a satisfactory hydrophobic treatment. For the alkylalkoxysilane, n is preferably 4 to 8, and m is preferably 1 or 2. An amount of the alkylalkoxysilane used for the treatment is preferably 1 to 60 parts by mass, more preferably 3 to 50 parts by mass with respect to 100 parts by mass of the inorganic fine powder before the treatment.

The hydrophobic treatment of the fluidity improver may be performed by using one kind of the hydrophobic treatment agent; or by using two or more kinds of the agents in combination. For example, the hydrophobic treatment may be performed by using one kind of the hydrophobic treatment agent alone, by using two kinds of the hydrophobic treatment agents simultaneously, or by first using one kind of the hydrophobic treatment agent for the hydrophobic treatment and then another hydrophobic treatment agent for further treatment.

The fluidity improver is added in an amount of preferably 0.01 to 5 parts by mass, and more preferably 0.05 to 3 parts by mass with respect to 100 parts by mass of the cyan toner particles.

The following colorants may be used for the pale cyan toner of the present invention and a different color toner used in combination with the deep cyan toner having an L* value smaller than that of the pale toner.

Examples of a black colorant include carbon black, a magnetic material, magnetite, and a colorant toned to black color using three colors of a yellow colorant, a magenta colorant, and a cyan colorant.

Examples of the yellow colorant preferably used include compounds such as condensed azo compounds, isoindolinone compounds, anthraquinone compounds, azo metal complexes, methine compounds, and allylamide compounds. Specific examples thereof include C.I. Pigment Yellow 12, 13, 14, 15, 17, 62, 74, 83, 93, 94, 95, 97, 109, 110, 111, 120, 127, 128, 129, 147, 155, 168, 174, 176, 180, 181, and 191.

Examples of the magenta colorant include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples of the particularly preferable magenta colorant include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 254, and C.I. Pigment Violet 19.

Examples of the magnetic material include metal oxides containing elements of iron, cobalt, nickel, copper, magnesium, manganese, aluminum, and/or silicon. The magnetic material preferably contains iron oxide such as ferrous ferric oxide and γ-ferric oxide as a main component. The magnetic material may also contain metal elements such as a silicon element or an aluminum element for controlling the charging property of a black toner. Particles of those magnetic materials have a BET specific surface area measured by nitrogen adsorption in the range of preferably 2 to 30 $m^2/g$, and particularly preferably 3 to 28 $m^2/g$. Mohs hardness thereof is preferably 5 to 7.

Examples of a shape of the magnetic material include octahedron, hexahedron, sphere, acicular, and scaly. The shape with small anisotropy such as octahedron, hexahedron, and sphere is preferable as the shape of the magnetic material for improving the image density. An average particle diameter of the magnetic material is preferably 0.05 to 1.0 μm, more preferably 0.1 to 0.6 μm, and furthermore preferably 0.1 to 0.4 μm.

A magnetic material content is 30 to 200 parts by mass, preferably 40 to 200 parts by mass, and more preferably 50 to 150 parts by mass with respect to 100 parts by mass of the binder resin. If the content is below 30 parts by mass, carrying ability degrades in the developing device using a magnetic force for carrying a black magnetic toner. A black magnetic toner layer easily becomes uneven on a developing sleeve, and a toner image easily becomes uneven. Further, the image density easily decreases, caused by an increase of the triboelectrification of the black magnetic toner. On the other hand, the fixability of the black toner degrades if the content exceeds 200 parts by mass.

The cyan toner is used in combination with a magnetic carrier when using the cyan toner of the present invention for a two-component developer. Examples of the magnetic carrier that can be used include magnetic material particles per se, a coated magnetic carrier containing the magnetic material particles coated with a resin, and a magnetic material dispersion-type resin carrier having the magnetic material particles dispersed in the resin particles. Examples of the magnetic material particles include: metal particles such as surface oxidized or not oxidized iron, lithium, calcium, magnesium, nickel, copper, zinc, cobalt, manganese, chromium, and rare earth metals; alloy particles thereof; oxide particles thereof; and ferrite.

A coated magnetic carrier having the surface of the magnetic material particles coated with a resin is particularly preferable for a developing method involving an application of an AC bias on the developing sleeve. A coating method that can be adopted includes: a method of adhering an application liquid, which is prepared by dissolving or suspending a resin in a solvent, to the surface of the magnetic material particles (magnetic carrier core particles); and a method of mixing the magnetic material particles and the resin in a powder form.

Examples of the resin coating the surface of the magnetic material particles include a silicone resin, a polyester resin, a styrene resin, an acrylic resin, polyamide, polyvinyl butyral, and an aminoacrylate resin. Those resins are used independently or in mixture. An amount of the resin used for coating treatment is preferably 0.1 to 30% by mass (preferably 0.5 to 20% by mass). These magnetic material particles have an average particle diameter of 10 to 100 μm, preferably 20 to 70 μm.

When preparing the two-component developer by mixing the cyan toner of the present invention and the magnetic carrier, a satisfactory result maybe provided with a mixing ratio at a cyan toner content of 2 to 15% by mass, and preferably 4 to 13% by mass in the two-component developer. If the toner content is below 2% by mass, the image density tends to decrease and if the toner content is above 15% by mass, fog or scattering of the cyan toner easily occurs inside the image forming apparatus.

The cyan toner preferably has an average circularity in the range of 0.920 to 0.945, and preferably 0.922 to 0.943 for particles having equivalent circle diameters of 2 μm or more. If the average circularity of the cyan toner is below 0.920, transferability degrades and the graininess of the image in the low-image density region is easily noticed, thus an image with roughness tends to form. On the other hand, if the average circularity of the cyan toner is above 0.945, a cleaning failure tends to occur in that the cyan toner passes through a cleaning blade during cleaning of the photoconductive drum. The average circularity of the cyan toner of the present invention can be adjusted by using a surface modification device described later.

Next, a production procedure of the cyan toner will be described. The cyan toner of the present invention can be produced by: melt-kneading a binder resin, a colorant, a wax, and optional materials; cooling and then pulverizing the mixture; optionally classifying the pulverized product; and optionally adding the fluidity improver.

In a mixing step of cyan toner ingredients, at least a binder resin, a colorant, and a wax are weighed for a given amount, and then combined and mixed. Examples of a mixing device include a double-cone mixer, a V-shaped mixer, a drum-type mixer, a Super Mixer, a Henschel mixer, and a Nautamixer.

The mixed toner ingredients are then melt-kneaded, and the colorant and the wax are dispersed in a binder resin. Examples of a melt-kneader include: a batch-type kneading machine such as a pressure kneader or a Banbury mixer; and a continuous kneading machine. In view of the advantages of continuous production, a single-screw or twin-screw extruder is preferably used as the melt-kneader. Examples of the melt-kneader include "KTK twin-screw extruder" (manufactured by Kobe Steel, Ltd.), "TEM twin-screw extruder" (manufactured by Toshiba Machine Co., Ltd.), a twin-screw extruder (manufactured by K.C.K. K.K.), and "KO-KNEADER" (manufactured by Buss A.G.). Further, a colored resin composition produced by melt-kneading the cyan toner ingredients is rolled by using a two-roller mill and then cooled through a cooling step such as water-cooling.

The cooled product of colored resin composition is then pulverized to have a desired particle diameter in a pulverizing step. In the pulverization step, the colored resin composition is first coarsely pulverized by using a pulverizer such as a crusher, a hammer mill, and a feather mill and then finely pulverized by using a pulverizer such as "Kryptron System" (manufactured by Kawasaki Heavy Industries, Ltd.) and "SuperRotor" (manufactured by Nisshin Engineering Inc.). The pulverized composition is then optionally classified to obtain cyan toner particles having a weight average particle diameter of 3 to 11 μm, by using a classifier such as an inertia-type classifier of "Elbow Jet" (manufactured by Nittetsu Mining Co., Ltd.) or a centrifugal classifier of "Turboplex" (manufactured by Hosokawa Micron Corporation).

The cyan toner particles are optionally subjected to surface modification and conglobation by using "Hybridization System" (manufactured by Nara Machinery Co., Ltd.) and "Mechanofusion System" (manufactured by Hosokawa Micron Corporation) in a surface modification step.

According to the present invention, it is preferable that the cyan toner particles having a weight average particle diameter of 3 to 11 μm be obtained by using a device for the classification and the surface modification treatment utilizing mechanical impact force after pulverizing the toner particles with air-jet pulverization without mechanical pulverization in the pulverizing step. The cyan toner may be subjected to the surface modification treatment and the classification separately, and in such a case, a seiving classifier such as a wind sieve such as "HI-BOLTER" (manufactured by New Tokyo Machinery K.K). Further, the classified cyan toner particles and various known external additives are combined in a specific amount, and the additives are externally added by using a high-speed mixer such as a Henschel mixer and a Super Mixer.

Figure 4:
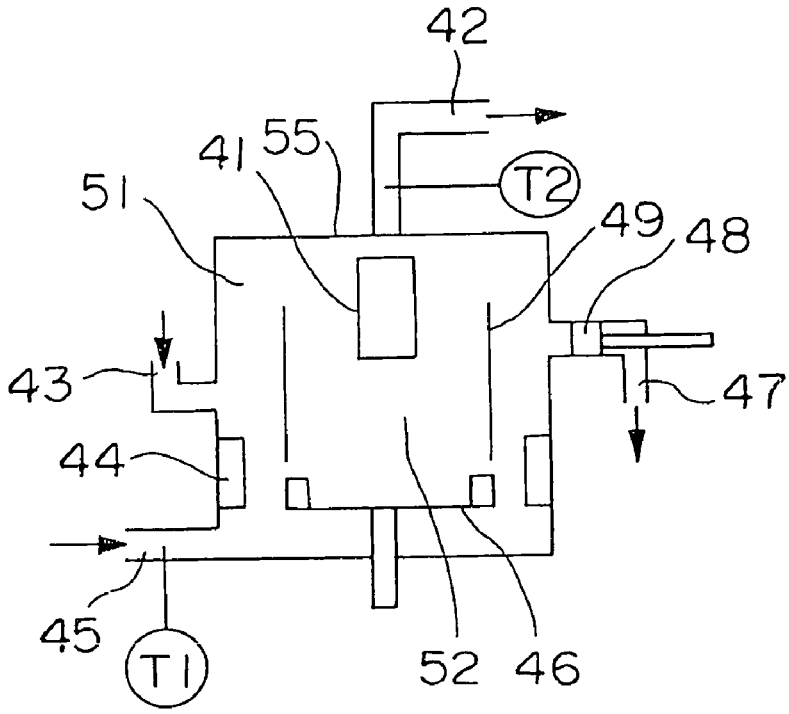
FIG. 4 is a schematic diagram showing a structure of an example of a surface modification device suitably used for producing a cyan toner of the present invention.

FIG. 4 shows an example of a surface modification device for the toner particles.

The surface modification device shown in FIG. 4 possesses: a casing 55; a jacket (not shown) which allows cooling water and anti-freeze to pass therethrough; a classification rotor 41 which is a classifying means for separating particles larger than a prescribed particle diameter and particles equal to or smaller than the prescribed particle diameter; a dispersion rotor 46 which is a surface treatment means for treating surface of particles by applying mechanical impact to the particles; a liner 44 provided around an outer periphery of the dispersion rotor 46 with a prescribed distance; a guide ring 49 which is a guiding means for guiding the particles larger than the prescribed particle diameter separated by the classification rotor 41; a fine powder recovery discharge port 42 which is a discharging means for discharging out of the device the fine powders smaller than the prescribed particle diameter separated by the classification rotor 41; a cool air introduction port 45 which is a particle circulating means for transferring to the classification rotor 41 the particles having the surface thereof treated in the dispersion rotor 46; a toner ingredient supply port 43 for introducing particles to be treated into the casing 55; a powder discharge port 47, which opens and closes freely, for discharging from the casing 55 the particles with the surface treated; and a discharge valve 48.

The classification rotor 41 is a cylindrical rotor and is located at one end, inside the casing 55. The fine powder recovery discharge port 42 is located in one end portion of the casing 55 to discharge the particles inside the classification rotor 41. The toner ingredient supply port 43 is located in the center portion of a peripheral wall of the casing 55. The cool air introduction port 45 is located on another end of the casing 55. The powder discharge port 47 is located on the peripheral wall opposite to the toner ingredient supply port 43. The discharge valve 48 is a valve which freely opens and closes the powder discharge port 47.

Figure 5:
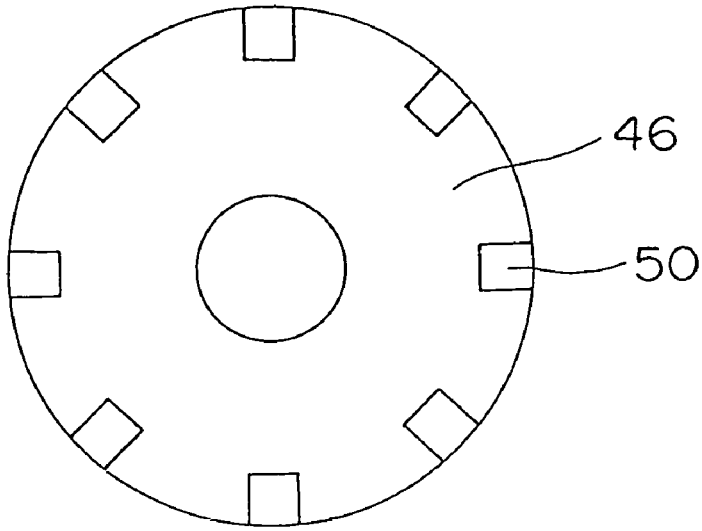
FIG. 5 is a diagram showing a dispersion rotor and an arrangement of square discs provided thereon, which are shown in FIG. 4.

The dispersion rotor 46 and the liner 44 are located between the cool air introduction port 45, and the toner ingredient supply port 43 and the powder discharge port 47. The liner 44 is located around the casing 55, along the inner periphery of the casing 55. The dispersion rotor 46 has a circular disc and a plurality of square discs 50 arranged on the limb of the circular disc along a normal of the circular disc as shown in FIG. 5. The dispersion rotor 46 is located on another end of the casing 55, and is arranged in a position forming a prescribed space between the liner 44 and the square discs 50. The guide ring 49 is located in the center portion of the casing 55. The guide ring 49 is cylindrical, and is located to extend from a position covering a portion of an outer periphery of the classification rotor 41 to a vicinity of the classification rotor 41. Inside of the casing 55 is divided by the guide ring 49 into a first space 51 which is a space between an outer periphery of the guide ring 49 and the inner periphery of the casing 55, and a second space 52 which is a space inside the guide ring 49.

The dispersion rotor 46 may be provided with cylindrical pins instead of the square discs 50. Multiple grooves are located on the liner 44 on a surface facing the square discs 50, but the liner 44 may not have grooves on its surface. The classification rotor 41 may be placed vertically as shown in FIG. 4 or horizontally. The number of the classification rotor 41 may be single as shown in FIG. 4 or plural.

In the surface modification device, a finely pulverized product is charged from the toner ingredient supply port 43 with the discharge valve 48 closed. The charged finely pulverized product is sucked by a blower (not shown) and then classified by the classification rotor 41. At this time, the classified fine powders smaller than the prescribed particle diameter are guided inside the classification rotor 41 while passing through the peripheral wall of the classification rotor 41 and continuously discharged and removed outside the device. Coarse powders larger than the prescribed particle diameter are guided along the inner periphery of the guide ring 49 (second space 52) to a gap between the square discs 50 and the liner 44 (hereinafter, the gap may be referred to as "surface modification zone") through centrifugal force, while being carried by a circulating flow generated by the dispersion rotor 46. The powder guided to the surface modification zone receives mechanical impact force between the dispersion rotor 46 and the liner 44, and the cyan toner particles are subjected to the surface modification treatment. The surface-modified cyan toner particles are guided to the classification rotor 41 along the outer periphery of the guide ring 49 (first space 51), while being carried by a cool air passing through the device, and the fine powders are discharged outside the device by the classification rotor 41. The coarse powders are carried by the circulating flow to be returned to the second space 52 again to be repeatedly subjected to surface modification. As described above, in the surface modification device shown in FIG. 4, the classification of the particles by the classification rotor 41 and the surface treatment of the particles by the dispersion 46 are repeated. After a certain time period, the surface-modified cyan toner particles are recovered from the discharge port 47 with the discharge valve 48 opened.

A time period from charging the finely pulverized product to opening the discharge valve (cycle time) and rpm of the dispersion rotor 46 are important for controlling the average circularity of the cyan toner particles and the amount of the wax existing on the surface of the cyan toner particles. Extending the cycle time or increasing the peripheral speed of the dispersion rotor 46 effectively increases the average circularity of the cyan toner particles. Shortening the cycle time and decreasing the peripheral speed, in contrast, effectively suppresses the amount of the wax existing on the surface of the particles. As described above, the peripheral speed of the dispersion rotor 46 is preferably $1.2\times10^5$ mm/second or more, and the cycle time is preferably 5 to 60 seconds from a view point of suitably adjusting the average circularity of the cyan toner particles and the amount of the wax existing on the surface.

A contact angle of the electrostatic latent image bearing member is preferably 85° or more (preferably 90° or more) with respect to water on the surface of the electrostatic latent image bearing member when forming an image using the cyan toner of the present invention. If the contact angle with respect to water is 85° or more, the transferability of the toner image improves and filming of the toner hardly occurs on the electrostatic latent image bearing member.

The method for forming an image of the present invention is particularly effective when a surface layer of the electrostatic latent image bearing member is mainly constituted of a high molecular weight binder. Examples of the cases where the method for forming an image of the present invention is particularly effective include a case of providing a protective film mainly consisting of a resin on an inorganic photosensitive layer such as selenium and amorphous silicon, a case where a surface layer consisting of a charge transport material and the resin is provided as a charge transport layer of a separated-function type organic photosensitive layer, and a case of providing the above protective layer on the separated-function organic photosensitive layer.

Examples of means for imparting releasability to the surface layer include: (1) using a resin with low surface energy for the resin itself constituting the surface layer, (2) adding an additive imparting water repellency and lipophilic property to the surface layer, and (3) dispersing a material having high releasability in a powder form, on the surface layer.

An introduction of a fluorine-containing group and a silicone-containing group to a structure of the resin, for example, may achieve releasability imparting means (1) An additive such as a surfactant may be used for the means (2). A powder of a fluorine compound such as polyethylene tetrafluoride, polyvinylidene fluoride, and carbon fluoride may be used for the means (3), and polyethylene tetrafluoride is particularly preferably used. An addition of a powder material having releasability such as a fluorine resin to the surface layer is particularly preferable for the means (3).

An amount of the powder material added to the surface layer is 1 to 60% by mass, preferably 2 to 50% by mass with respect to the total mass of the surface layer. If the amount is below 1% by mass, an improving effect is small. If the amount is above 60% by mass, film strength may decrease or amount of incident light to the electrostatic latent image bearing member may decrease undesirably.

The present invention is particularly effective for a direct charging method in which the charging means is brought into contact with the electrostatic latent image bearing member. The direct charging method poses a heavy load against the surface of the electrostatic latent image bearing member compared to a corona discharge in which the charging means is not in contact with the electrostatic latent image bearing member. Therefore, an improving effect is remarkable in terms of lifetime of the electrostatic latent image bearing member.

Hereinafter, a preferable mode of the electrostatic latent image bearing member used in the present invention will be described. The electrostatic latent image bearing member is structured with a conductive substrate and various layers formed on a surface thereof.

Examples of a material forming the conductive substrate include: metals such as aluminum and stainless steel; plastics having a coated layer of an alloy such as an aluminum alloy and indium oxide-tin oxide alloy; papers and plastics impregnated with conductive particles; and plastics having conductive polymers. A barrel or a film may be used for the substrate.

An undercoat layer may be provided on the conductive substrate for purposes of improving adhesion of the photosensitive layer, improving coating, protecting the substrate, coating defects on the substrate, improving charge injection from the substrate, and protecting against electrical destruction of the photosensitive layer. Examples of materials for the undercoat layer include polyvinyl alcohol, poly-N-vinylimidazole, polyethylene oxide, ethyl cellulose, methyl cellulose, nitrocellulose, an ethylene-acrylic acid copolymer, polyvinyl butyral, a phenol resin, casein, polyamide, copolymerized nylon, animal glue, gelatin, polyurethane, and aluminum oxide. Thickness of the undercoat layer is generally 0.1 to 10 μm, preferably 0.1 to 3 μm.

A charge generating layer is formed above the conductive substrate or the undercoat layer. The charge generating layer is formed by dispersing a charge generating substance in an appropriate binder and then coating or vapor depositing the binder in which the charge generating substance is dispersed to the substrate or the layer. The charge generating substance is composed of substances examples of which includes: organic materials such as an azo pigment, a phthalocyanine pigment, an indigo pigment, aperylene pigment, a polycyclic quinone pigment, as quarylium dye, pyrylium salts, thiopyrylium salts, and a triphenylmethane dye; and inorganic substances such as selenium and amorphous silicon. Examples of the binder include a polycarbonate resin, a polyester resin, a polyvinyl butyral resin, a polystyrene resin, an acrylic resin, a methacrylic resin, a phenol resin, a silicone resin, an epoxy resin, and a vinyl acetate resin. An amount of the binder in the charge generating layer is 80% by mass or less, preferably 0 to 40% by mass. Thickness of the charge generating layer is 5 μm or less, particularly preferably 0.05 to 2 μm.

A charge transporting layer is formed on the electrostatic latent image bearing member to lay on top of the charge generating layer. The charge transporting layer has a function of receiving a charge carrier from the charge generating layer in the presence of an electrical field and transporting the charge carrier. The charge transporting layer is formed by dissolving a charge transporting substance, as required, with a binder resin in a solvent, followed by coating. Thickness of the charge transporting layer is generally 5 to 40 μm. Examples of the charge transporting substance include: polycyclic aromatic compounds having a structure of biphenylene, anthracene, pyrene, and phenanthrene on a main chain or a side chain; nitrogen-containing cyclic compounds such as indole, carbazole, oxidiazole, and pyrazoline; a hydrazone compound; a styryl compound; and inorganic compounds such as selenium, selenium-tellurium, amorphous silicon, and cadmium sulfide.

Examples of the binder resin in which those charge transporting substances are dispersed include: resins such as a polycarbonate resin, a polyester resin, polymethacrylate, a polystyrene resin, an acrylic resin, and a polyamide resin; and organic photoconductive polymers such as poly-N-vinyl carbazole and polyvinyl anthracene.

A protective layer may be provided on a surface of the electrostatic latent image bearing member as a surface layer. Examples of a resin used for the protective layer include polyester, polycarbonate, an acrylic resin, an epoxy resin, a phenol resin, or a compound prepared by curing those resins using a curative. Those resins may be used independently or in combination of two or more kinds thereof.

Conductive fine particles may be dispersed in the resin of the protective layer. Examples of the conductive fine particles include fine particles of metals or metal oxides. Preferable examples of materials for the fine particles include zinc oxide, titanium oxide, tin oxide, antimony oxide, indium oxide, bismuth oxide, tin oxide-coated titanium oxide, tin-coated indium oxide, antimony-coated tin oxide, and zirconium oxide. Those materials may be used independently or in a mixture of two or more kinds. When dispersing the conductive fine particles in the protective layer, in general, the conductive fine particles preferably have a particle diameter smaller than wavelength of an incident light to prevent scattering of the incident light caused by the conductive fine particles. The conductive fine particles dispersed in the protective layer preferably have a particle diameter of 0.5 μm or less. An amount of the conductive fine particles in the protective layer is preferably 2 to 90% by mass, more preferably 5 to 80% by mass with respect to the total mass of the protective layer. Thickness of the protective layer is preferably 0.1 to 10 μm, more preferably 1 to 7 μm.

The surface layer can be coated with a resin dispersion by spray coating, beam coating, or penetration coating.

Surface roughness of a toner carrier used in the present invention is preferably in the range of 0.2 to 3.5 μm according to the JIS centerline average roughness (Ra). If Ra is smaller than 0.2 μm, charge amount on the toner carrier tends to be large, and thus, the developability tends to degrade easily. If Ra exceeds 3.5 μm, a toner-coated layer on the toner carrier easily becomes uneven. The surface roughness is more preferably in the range of 0.5 to 3.0 μm.

Further, in the method for forming an image according to the present invention, the total charge amount of the cyan toner is preferably controlled. From the above view, a surface of the toner carrier is preferably formed by a resin layer in which one or both of the conductive fine particles and a lubricant are dispersed.

Examples of the conductive fine particles in the resin layer forming the surface of the toner carrier include carbon black, graphite, conductive metal oxides such as conductive zinc oxide, and metal multiple oxides. Those may preferably be used independently, or in combination of two or more kinds. Examples of the resin in which the conductive fine particles are dispersed include resins such as a phenol resin, an epoxy resin, a polyamide resin, a polyester resin, a polycarbonate resin, a polyolefin resin, a silicone resin, a fluorine resin, a styrene resin, and an acrylic resin. Thermosetting resin or photo-curing resin is particularly preferable.

According to the present invention, a member restricting the cyan toner on the toner carrier is preferably provided in contact with the toner carrier through the cyan toner for uniformly charging the cyan toner. The member is particularly preferably an elastic member. According to the present invention, a charge member and a transfer member are preferably in contact with the electrostatic latent image bearing member to prevent ozone generation for reducing image deletion phenomenon.

Figure 6:
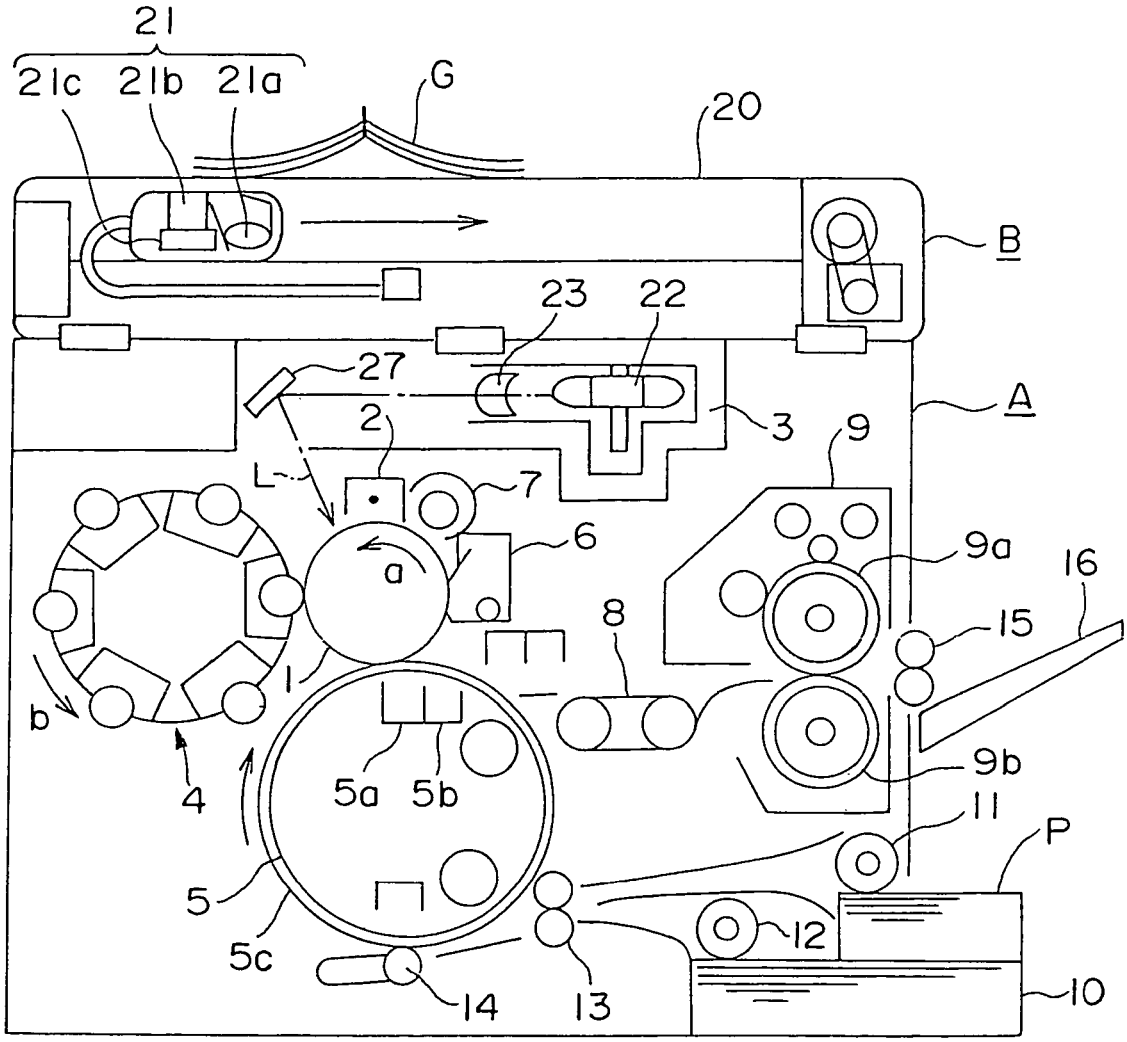
FIG. 6 is a schematic diagram showing a structure of an example of an apparatus for forming an image used in full-color image formation employing a cyan toner of the present invention.

Next, the method for forming an image using the cyan toner of the present invention will be specifically described with reference to FIG. 6. In FIG. 6, a reference symbol A represents a printer part, and a reference symbol B represents an image reader part (image scanner) mounted on the printer part A. According to the method for forming an image using the cyan toner of the present invention, an electrostatic latent image forming means (exposure device described later, for example) is used because two or more kinds of the toners are generally used. The electrostatic latent image forming means can form an electrostatic latent image according to shading or a kind of the toner.

The image reader part B possesses a fixed, original table glass 20. An original G is set by placing on a top surface of the original table glass 20 with its printing surface facing down and placing an original plate (not shown) over the original. An image reader unit 21 is arranged with an original irradiating lamp 21*a*, a short focus lens array 21*b*, a charge coupled device (CCD) sensor 21*c* as a full-color sensor, or the like.

The image reader unit 21 is driven forward by pressing a copy button (now shown). The image reader unit 21, under the original table glass 20 in FIG. 6, moves along an undersurface of the glass from a home position on a left side to a right side with respect to a paper surface in FIG. 6 on the original glass table 20. The image reader unit 21 is then driven backward to return to the initial home position, reaching a prescribed end of a reciprocating motion.

During the course of the image reader unit 21 driven forward, an image surface of the set original G facing down on the original glass table 20 is sequentially irradiated and scanned from the left side to the right side by the original irradiating lamp 21*a*. The irradiated and scanned light reflected by the original surface is converged by the short focus lens array 21*b* and enters the CCD sensor 21*c*.

The CCD sensor 21*c* is constructed with a photo-receiving unit, a transmitting unit, and an output unit (all not shown). The photo-receiving unit converts light signals into charge signals. The charge signals synchronize with a clock pulse at the transmitting unit and are sequentially transmitted to the output unit. In the output unit, the charge signals are converted into voltage signals, and are then amplified and modified into signals having low impedance to output analog signals. The analog signals thus-obtained are converted into digital signals through a known image processing for output to the printer part A. An image information of the original G is photoelectrically read as a time series electrical digital pixel signal (image signal) by the image reader part B.

Figure 7:
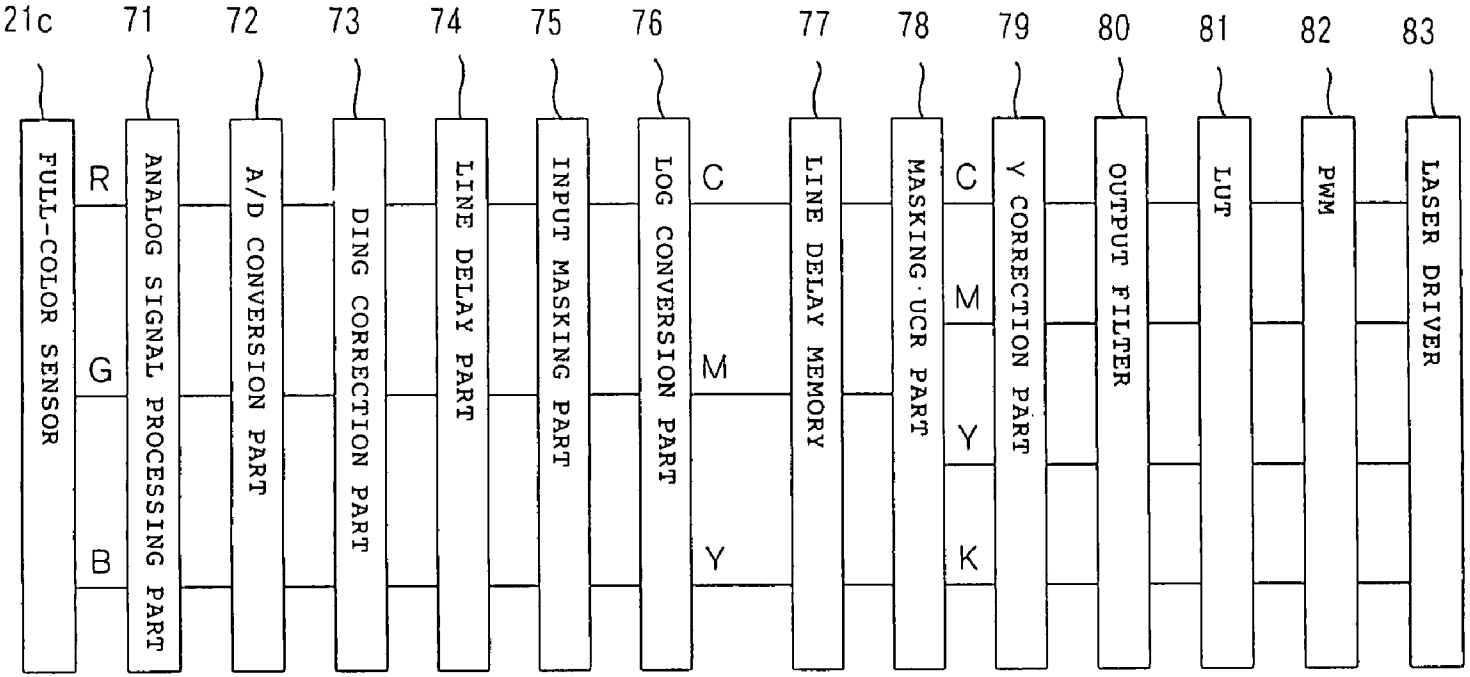
FIG. 7 is a block diagram showing an example of image processing through an image forming apparatus shown in FIG. 6.

FIG. 7 shows a block diagram of one example of the image processing. In FIG. 7, the output image signals from the full-color sensor 21*c* enter an analog signal processing part 71 to adjust gain and offset of the signals. The image signals are then converted into RGB digital signals of 8 bit (0 to 255 level: 256 gradation), for example, for respective color components at an A/D conversion part 72. In a shading correction part 73, the gain of the signals is optimized by adjusting the gain corresponding to each one of CCD sensor cells using signals obtained by reading reference white color plates (not shown) for respective colors to reduce variation in sensitivities of each of the CCD sensor cells aligned, for a known shading correction.

A line delay part 74 corrects a spatial deviation in the output image signal from the shading correction part 73. The spatial deviation was caused from each of line sensors of the full-color sensor 21*c* arranged with a given space therebetween in a sub-scanning direction. To be specific, each of red (R) and green (G) color component signals is line delayed in the sub-scanning direction based on a blue (B) color component signal, for phase of the three color component signals being synchronized with each other.

An input masking part 75 converts a color space of the image signals output from the line delay part 74 to an NTSC standard color space through a matrix operation. In other words, the color space of each of the color component signals output from the full-color sensor 21*c*, defined by spectral properties of a filter for each corresponding color component, is converted into the NTSC standard color space.

A LOG conversion part 76 includes a look-up table (LUT) consisting of ROM or the like, for example, and converts RGB luminance signals output from the input masking part 75 into CMY density signals. The line delay memory 77 delays the image signals output from the LOG conversion part 76 for a period (line delay) equal to the period that a black character determining part (not shown) forms control signals such as UCR, FILTER, or SEN from the output of the input masking portion 75.

A masking•UCR part 78 extracts black component signals K from the image signals output from the line delay memory 77. The signals are then subjected to the matrix operation correcting color turbidity of a recording color material of the print part on the Y, M, C, and K signals, to output 8-bit color component image signals, for example, in an order of M, C, Y, and K for each of reading operations of the reader part. A matrix coefficient used for the matrix operation is defined by CPU (not shown).

Next, based on the obtained 8-bit color component image signals (Data), a process is performed to determine recording rates of deep dots Rn and pale dots Rt. For example, if the input gradation data (Data) is 100/255, the recording rate Rt of the pale dots is defined as 250/255 and the recording rate Rn of the deep dots is defined as 40/255. The recording rate is represented by an absolute value such that 255 corresponds to 100%.

A γ-correction part 79 performs density correction on the image signals output from the masking•UCR part 78 to match the image signals with ideal gradation property of the printer part. An output filter (space filter processing part) 80 performs edge emphasis or smoothing processing on the image signals output from the γ-correction part 79 in accordance with the control signals from the CPU.

An LUT 81 is provided for conforming density of an original image with the density of an output image. The LUT 81 includes a RAM or the like, for example, and a translation table of the LUT 81 is set by the CPU. A pulse width modulator (PWM) 82 generates pulse signals having a pulse width corresponding to the level of input image signals. The pulse signals enter a laser driver 83 that drives a semiconductor laser (laser source).

The apparatus for forming an image of the present invention has a pattern generator (not shown) mounted and a gradation pattern is registered, allowing a direct pass of the signals to the pulse width modulator 82.

An exposure device 3 forms an electrostatic latent image by irradiating laser scanning exposure light L to a surface of the photoconductive member 1 as the electrostatic latent image bearing member, based on the image signals entering from the image reader unit 21.

Figure 8:
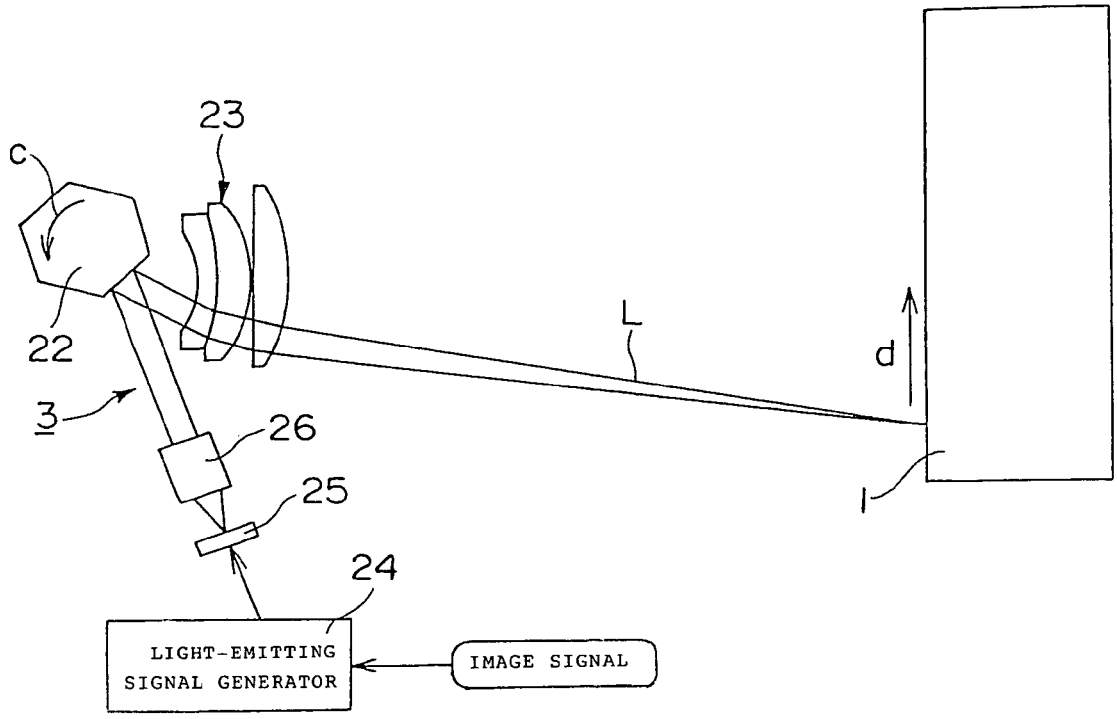
FIG. 8 is a schematic diagram showing a structure of an exposure device of an apparatus for forming an image shown in FIG. 6.

FIG. 8 is a schematic diagram showing a structure of the exposure device 3. When the surface of the photoconductive member 1 is irradiated with laser scanning exposure light L using the exposure device 3, a solid laser element 25 is caused to blink (turn on and off) at a prescribed timing using a light-emitting signal generator 24, based on the image signals entering from the image reader unit 21. Then, laser beams provided as light signals irradiated from the solid laser element 25 are converted into light flux substantially parallel using a collimator lens system 26. Further, the photoconductive member 1 is scanned in the direction of an arrow d (longitudinal direction) by a rotating polygonal mirror 22 rotated at high speed in the direction of an arrow c, so that a laser spot is formed on the surface of the photoconductive member 1 from the light flux passing through an fθ lens group 23 and a reflective mirror. As a result, such a laser scanning movement forms exposure distribution corresponding to the scanning movement on the surface of the photoconductive member 1. Further, the exposure distribution based on the image signals can be formed on the surface of the photoconductive member 1 by vertically scrolling only a prescribed distance for each scanning movement on the surface of the photoconductive member 1.

The charged surface (charged to −700 V, for example) of the photoconductive member 1 is scanned with the rotating polygonal mirror 22 rotated at a high speed using light emitted from the solid laser element 25, which emits light by turning on and off corresponding to the image signals. Thus, electrostatic latent images of the respective colors corresponding to scanning exposure patterns are formed on the surface of photoconductive member 1.

Figure 9:
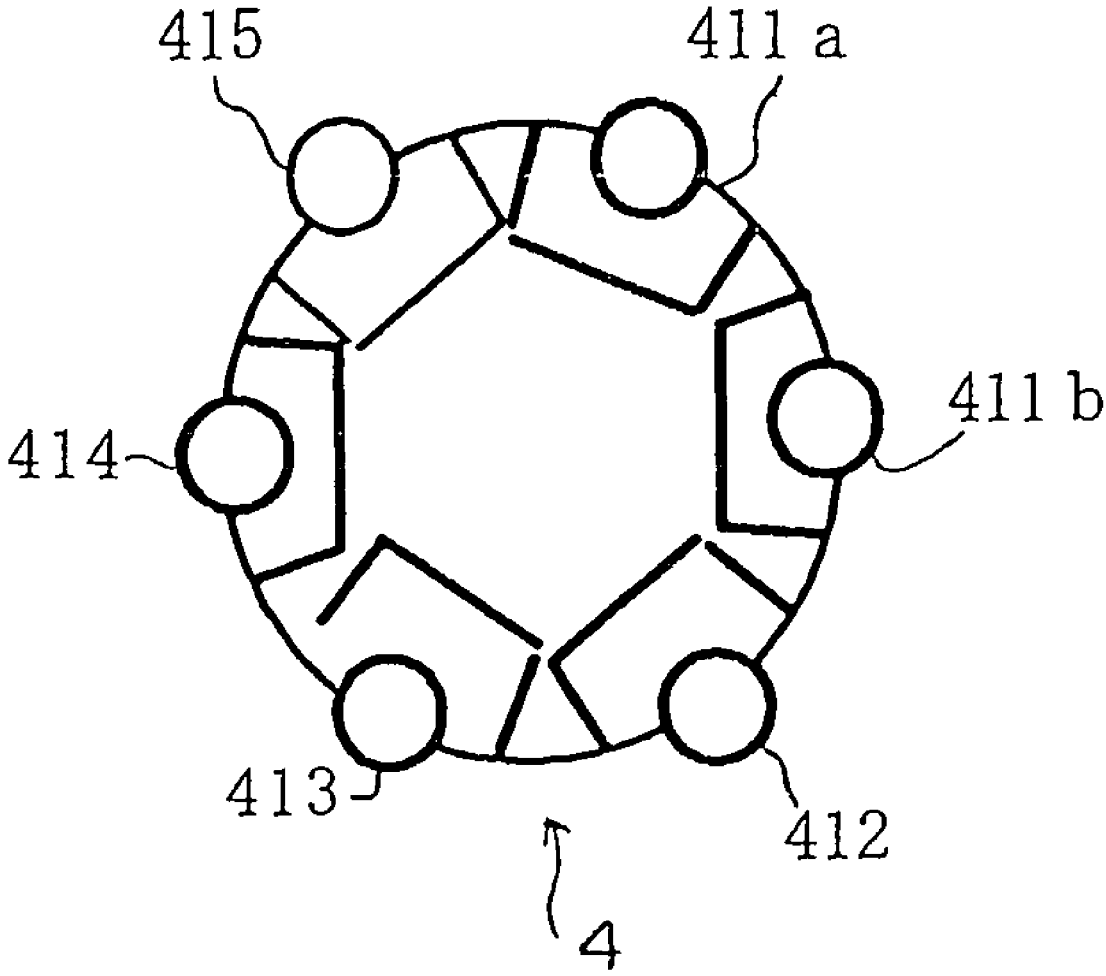
FIG. 9 is a schematic diagram showing a structure of a developing device of an apparatus for forming an image shown in FIG. 6.

As shown in FIG. 9, the developing device 4 includes developing units 411*a*, 411*b*, 412, 413, 414, and 415, and those developing units contain a developer having a pale cyan toner a, a developer having a deep cyan toner b, a developer having a magenta toner, a developer having a yellow toner, and a developer having a black toner, respectively. Each of the developers containing the respective toners develops an electrostatic latent image formed on the photoconductive member 1 through a suitable developing system according to a kind of the toner, thereby forming a toner image on the photoconductive member 1. Five kinds of the developers according to the present invention may be held in any developing units selected from the above six developing units, and an order of colors in the respective developing units does not matter. Further, the remaining developing unit may have an additional developer of another pale toner, a specific color toner such as green, orange, or white, or a colorless toner without a colorant. A two-component developing unit shown in FIG. 10 is a preferable example of those developing units.

Figure 10:
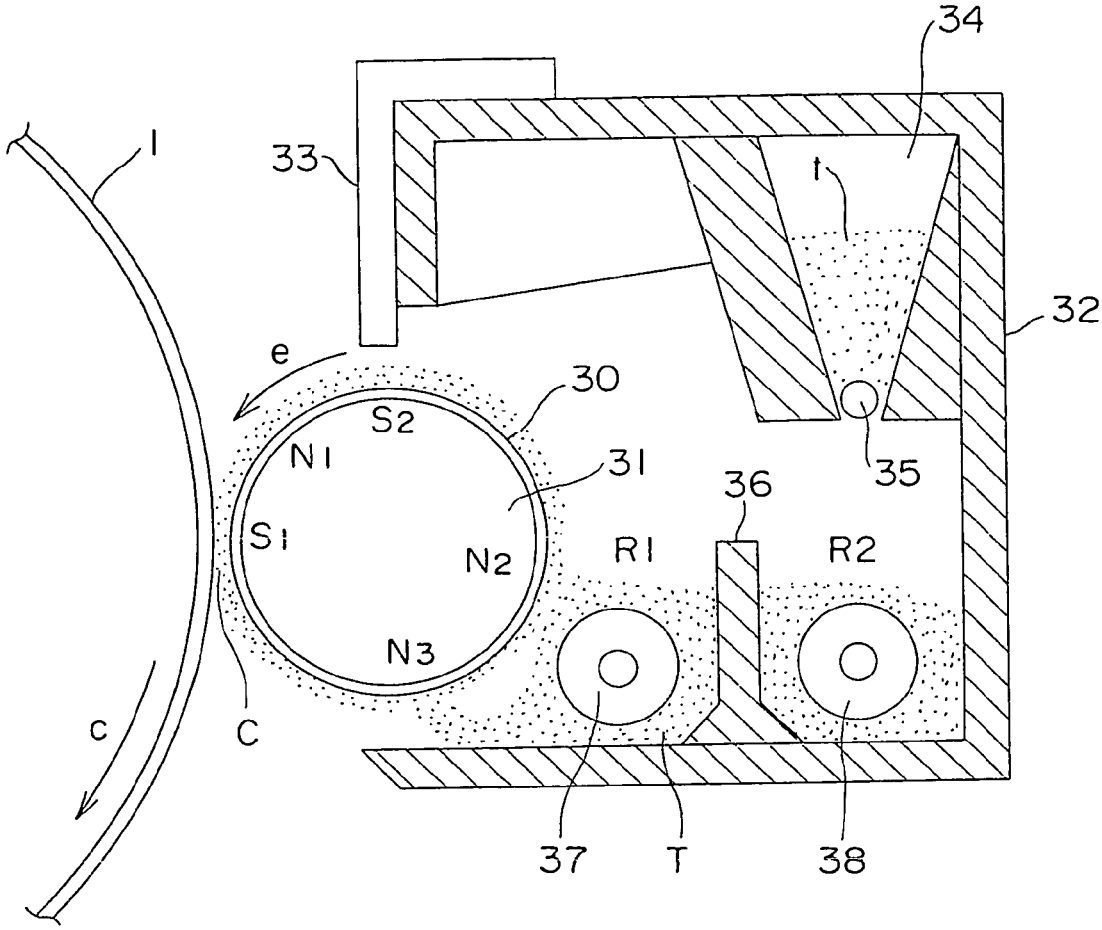
FIG. 10 is a schematic diagram showing an example of a structure of a developing unit of a developing device shown in FIG. 9.

In FIG. 10, the two-component developing unit has a developing sleeve 30 which can be driven to rotate in a direction of an arrow e. In the developing sleeve 30, a magnetic roller 31 is fixed in place. In a developer container 32, a restricting blade 33 (non-magnetic metal plate provided with a space from the surface of the developing sleeve) is provided for forming a thin layer of a developer T on the surface of the developing sleeve 30.

Further, inside of the developer container 32 is partitioned into a developing chamber (first chamber) R1 and a stirring chamber (second chamber) R2 by a partition wall 36. A toner hopper 34 is arranged above the stirring chamber R2. Carry screws 37, 38 are arranged in the developing chamber R1 and the stirring chamber R2, respectively. A supply port 35 is provided in the toner hopper 34, to supply toner t into the stirring chamber R2 through the supply port 35 when supplying the toner t.

On the other hand, the developer T, containing the toner and the magnetic carrier mixed, is held in the developing chamber R1 and the stirring chamber R2.

The developer T in the developing chamber R1 is carried toward the longitudinal direction of the developing sleeve 30 by a rotating drive of the carry screw 37. The developer T in the stirring chamber R2 is carried toward the longitudinal direction of the developing sleeve 30 by a rotating drive of the carry screw 38. The direction toward which the developer is carried by the carry screw 38 is opposite to that by the carry screw 37.

The partition wall 36 has openings (not shown) on the near side and the far side, perpendicular to the plane of the figure. The developer T carried by the carry screw 37 is delivered from one opening to the carry screw 38, while the developer T carried by the carry screw 38 is delivered from the other opening to the carry screw 37. Thus, the toner is triboelectrificated to a polarity for developing a latent image with the magnetic carrier.

The developing sleeve 30 made of a non-magnetic material such as aluminum or non-magnetic stainless steel is provided at the opening formed in a portion near the photoconductive member 1 of the developer container 32. The developing sleeve 30 rotates in the direction of the arrow e (counterclockwise) to carry the developer T containing the toner and the magnetic carrier mixed to the developing part C. A magnetic brush of the developer T supported by the developing sleeve 30 is brought into contact with the photoconductive member 1 rotated in the direction of the arrow a (clockwise) in the developing part C, thereby developing the electrostatic latent image in the developing part C.

An oscillation bias voltage superimposing a direct voltage on an alternating voltage is applied on the developing sleeve 30 from a power source (not shown). A dark potential (potential of the non-exposed portion) and a light potential (potential of the exposed portion) of the latent image are positioned between the maximum value and the minimum value of the above oscillation bias voltage. As a result, an alternating electric field alternately changing direction is formed in the developing part C. In the alternating electric field, the toner and the magnetic carrier vibrate vigorously enough to allow the toner to escape from electrostatic constraint against the developing sleeve 30 and the magnetic carrier. Thus, the toner adheres to the light portion of the surface of the photoconductive member 1 corresponding to the latent image.

A difference (peak-to-peak voltage) between the maximum value and the minimum value of the above oscillation bias voltage is preferably 1 to 5 kV (rectangular wave of 2 kV, for example). Further, a frequency of the oscillation bias voltage is preferably 1 to 10 kHz. A waveform of the oscillation bias voltage is not limited to a rectangular wave, and may be a sine wave or a triangular wave.

The direct voltage component has a potential value between the dark potential and the light potential of the electrostatic latent image. The value expressed by an absolute value is preferably closer to the dark potential than the minimum light potential for preventing the adhesion of the toner that causes fogging in a dark potential region. For example, the light potential may be −200V and the direct voltage component of the developing bias may be −500V with respect to the dark potential of −700V. A minimum gap (located inside the developing part C) between the developing sleeve 30 and the photoconductive member 1 is preferably 0.2 to 1 mm (0.5 mm, for example).

The amount of the developer T carried to the developing part C by being restricted by the restricting blade 33 is preferably defined such that a height of the magnetic blush of the developer T on the surface of the developing sleeve 30, formed by the magnetic field, formed by the developing magnetic pole S1 of the magnetic roller 31, in the developing part C, becomes 1.2 to 3-folds of the minimum gap between the developing sleeve 30 and the photoconductive member 1, with the photoconductive member 1 removed. The amount of the developer may be 700 μm if the minimum gap is 500 μm (0.5 mm), for example.

A developing magnetic pole S1 of the magnetic roller 31 is arranged at a position facing the developing part C. The developing magnetic pole S1 forms a developing magnetic field in the developing part C, allowing the formation of a magnetic brush of the developer T. The magnetic brush is then brought into contact with the photoconductive member 1 to develop a dot-distributed electrostatic latent image. At this time, the toner adhered on the ears (magnetic brush) of the magnetic carrier and the toner adhered on the surface of the sleeve instead of the ears are transferred to an exposure part of the electrostatic latent image to develop the electrostatic latent image.

Strength of the developing magnetic field formed by the developing magnetic pole S1 on the surface of the developing sleeve 30 (magnetic flux density in the direction perpendicular to the surface of the developing sleeve 30) preferably has a peak value of $5\times10^{-2}$ (T) to $2\times10^{-1}$ (T). The magnetic roller 31 includes N1, N2, N3, and S2 poles in addition to the above developing magnetic pole S1.

The developing step for developing the electrostatic latent image on the surface of the photoconductive member 1 through a two-component magnetic brush method using the developing device 4 and a circulating system of the developer T will be described below.

The developer T drawn by rotation of the developing sleeve 30 at the N2 pole is carried from the S2 pole to the N1 pole. In the middle of the carry, the restricting blade 33 restricts the layer thickness of the developer to form a developer thin layer. Then, the brushed developer T in the magnetic field of the developing magnetic pole S1 develops the electrostatic latent image on the photoconductive member 1. Subsequently, the developer T on the developing sleeve 30 drops into the developing chamber R1 by repulsive magnetic field between the N3 pole and the N2 pole. The developer T dropped into the developing chamber R1 is stirred and carried by the carry screw 37.

In the present invention, a general intermediate transfer member and a general transfer means can be adopted.

A transfer member 5 has a transfer sheet 5*c* formed with a polyethylene terephthalate resin film, extending on the surface thereof, and is provided to freely abut to or separate from the photoconductive member 1. The transfer member 5 is rotationally driven in the direction of an arrow (clockwise) The transfer member 5 has a transfer charger 5*a* and a separation charger 5*b* therein.

Next, an image forming operation of the above apparatus for forming an image will be described.

The photoconductive member 1 is rotationally driven around a central shaft at a prescribed peripheral velocity (process speed) in the direction of the arrow a (counterclockwise). During the rotation, the photoconductive member 1 receives a uniform charging treatment with a negative polarity by a primary electric charger 2 according to the embodiment mode of the present invention.

A scanning exposure light L with a laser beam modified based on the image signals output from the image reader part B to the printer part A is irradiated from the exposure device (laser scanning device) 3 to the uniformly charged surface of the photoconductive member 1 to sequentially form electrostatic latent images of each color corresponding to the image information on the original G, photoelectrically read by the image reader part B, on the photoconductive member 1. A first color toner image is formed by reversely developing the electrostatic latent image, formed on the photoconductive member 1 using the developing device 4, through the above two-component magnetic brush method.

On the other hand, synchronizing with the formation of the above toner image on the photocoductive member 1, a transfer material P such as a sheet of paper stored in a feeder cassette 10 is fed one by one with a feed roller 11 or 12, followed by feeding to a transfer member 5 by a resist roller 13 at a prescribed timing. Subsequently, the transfer material P is electrostatically adsorbed on the transfer member 5 by an adsorption roller 14. The transfer material P electrostatically adsorbed on the transfer member 5 is shifted to a position facing the photoconductive member 1 by a rotation of the transfer member 5 in the direction of the arrow (clockwise). Then, the transfer charger 5*a* provides charges of a reverse polarity with respect to the above toner to the back side of the transfer material P, transferring a toner image from the photoconductive member 1 to the front side of the transfer material P.

A remaining toner on the photoconductive member 1 after the transfer is removed by a cleaning device 6, and a subsequent toner image is formed.

Hereinafter, the electrostatic latent image on the photoconductive member 1 is developed similarly, and the pale cyan toner image a, the deep cyan toner image b, the magenta toner image, the yellow toner image, and the black toner image are transferred to the transfer material P on the transfer member 5 by the transfer charger 5*a*.

The transfer material P having the toner image of each color is separated from the transfer member 5 by the separation charger 5*b*, followed by carrying the separated transfer material P to a fixing device 9 via a carry belt 8. The transfer material P carried to the fixing device 9 is heated under pressure between a fixing roller 9*a* and a pressurizing roller 9*b* to fix a full-color image on the surface of the transfer material P. Then, the transfer material P is discharged on a tray 16 by a discharge roller 15.

The remaining toner on the surface of the photoconductive member 1 after the transfer is removed by the cleaning device 6. Then, the charge on the surface of the photoconductive member 1 is eliminated by a pre-exposure lamp 7, to prepare for subsequent image formation.

A toner image of each color can be directly transferred to a transfer material by using an apparatus for forming an image (tandem-type apparatus for forming an image) including, for example: an electrostatic latent image bearing member; a charge means of the electrostatic latent image bearing member; an exposure device; a developing device; a transfer means provided corresponding to the electrostatic latent image bearing member; plural cleaning devices (for number of kinds of toners); a carry means for sequentially carrying one transfer material to a transfer position of the transfer means; and a fixing device. Thus, an image using two or more kinds of the toner can be formed without using the transfer member 5 (or intermediate transfer member).

Next, preferable methods for measuring various physical properties of the cyan toner of the present invention will be described.

(Measurement of the Molecular Weight of the Toner, the Binder Resin, and the Wax Dispersion Medium by GPC)

The molecular weight distribution of the resin component, the binder resin, and the wax dispersion medium of the toner are determined by using a THF soluble content prepared by dissolving a measurement sample in a THF solvent by means of GPC.

The sample is placed in the THF solvent, left to stand for several hours, and shaken sufficiently, to mix well with the THF (until aggregates of the sample disappear). Then, the mixture is left at rest for over 12 hours. The elapsed time of the sample left at rest in the THF is over 24 hours by this time. Then, the mixture is passed through a sample treatment filter (Maesyori-disc H-25-5, pore size 0.45 to 0.5 μm, available from Tosoh Corporation; and Ekicrodisc 25CR, available from Gelman Sciences Japan, Ltd., for example) to prepare a sample for the GPC. The sample concentration is adjusted so that concentration of the resin component is 0.5 to 5 mg/ml. The GPC measurement of the sample prepared by the above method involves: stabilizing a column in a heat chamber at 40° C., passing tetrahydrofuran (THF) as a solvent through the column at the above temperature at a flow rate of 1 ml/min, and injecting about 50 to 200 μl of the THF sample solution of the resin adjusted to the sample concentration of 0.05 to 0.6% by mass.

Several, commercially-available polystyrene gel columns are preferably used in combination for accurately measuring a molecular weight range of $10^3$ to $2\times10^6$. Examples of the combinations thereof can include: a combination of shodex GPC KF-801, 802, 803, 804, 805, 806, and 807, available from SHOWA DENKO K.K.; and μ-styragel 500, $10^3$, $10^4$, and $10^5$, available from Waters Corporation. A refractive index (RI) detector is used for a detector.

Measurement of the molecular weight of the sample involves calculating the molecular weight distribution of the sample from a relationship between a logarithmic value of a calibration curve prepared by using several monodispersed polystyrene standard samples and a count value (retention time). Examples of the standard polystyrene samples for preparing the calibration curve include polystyrenes having molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, available from Tosoh Corporation or Pressure Chemical Co. At least 10 standard polystyrene samples are appropriately used.

(Measurement of the Molecular Weight of the Wax Using GPC)

Apparatus: "GPC-150C" (manufactured by Waters Corporation)

Column: "GMH-HT" 30 cm-binary (available from Tosoh Corporation)

Temperature: 135° C.

Solvent: o-dichlorobenzene (containing 0.1% by mass of ionol)

Flow rate: 1.0 ml/min

Sample: 0.4 ml of a 0.15% by mass wax

The measurement is carried out under the above conditions, the molecular weight of the wax is calculated by using the molecular weight calibration curve prepared from monodisperse polystyrene standard samples. Further, the molecular weight of the wax is calculated by converting the values into polyethylene equivalents using a conversion equation based on the Mark-Houwink viscosity equation.

(Measurement of the Maximal Value of the Maximum Heat-absorption Peak Temperature of the Toner and the Wax)

The maximum heat absorption peak temperature of the toner and the wax can be measured by using a differential scanning calorimeter (DSC) such as "DSC-7" (manufactured by Perkin-Elmer Corp.) and "DSC2920" (manufactured by TA Instruments Japan Inc.) according to ASTM D3418-82.

A sample of 5 to 20 mg, preferably about 10 mg, is accurately weighed. The sample is placed in an aluminum pan and subjected to measurement in a temperature range of 30 to 200° C. at following rates of temperature increase and decrease of 10° C./min, using a blank aluminum pan as a reference.

Temperature curve:

Temperature increase I (30 to 200° C., rate of temperature increase of 10° C./min)

Temperature decrease I (200 to 30° C., rate of temperature decrease of 10° C./min)

Temperature increase II (30 to 200° C., rate of temperature increase of 10° C./min)

The highest peak from a baseline in a region equal to or above a heat-absorption peak of the resin Tg or, in the case where it is difficult to discriminate the highest peak due to overlapping of the heat-absorption peak of the resin Tg and another heat-absorption peak, the highest peak of overlapping peaks thereof in the course of the temperature increase II is defined as the maximal value of the maximum heat-absorption peak temperature of the toner and the wax.

(Measurement of the Dispersion Diameter of the Colorant Particles)

The toner is added to a 2.3M sucrose solution, followed by sufficient stirring. A small amount of the resulting solution is applied to a sample holder pin, then, is subsequently put into liquid $N_2$ to solidify, and is immediately set on a sample arm head.

Using ultramicrotome FC4E (manufactured by Nissei Sangyo K.K.) provided with a cryogenic device, the solidified product is cut for preparing samples according to a conventional method.

Photographs of the samples are taken by using an electron microscope H-8000 Type (manufactured by Hitachi, Ltd.) at an accelerating voltage of 100 kV. Magnifications are arbitrarily set in accordance with the samples.

The image information thus obtained is entered to an image analyzer (Luzex 3, manufactured by Nireco Corporation) through an interface to convert into binary image data. Among the colorant particles, only particles having a particle size of 0.1 μm or more, which is pigment particles, for example, are analyzed at random, where the measurement is repeated until the sampling has been made over 300 times. Thus, the number average particle diameter and the particle diameter distribution of the colorant particles necessary for the present invention are determined.

Here, only the particles larger than 0.1 μm are used for the measurement. The particle diameter referred to in the present invention is a value defined by a diameter obtained after approximating the image of each colorant particle to a sphere.

(Measurement of the Average Circularity of the Toner)

The average circularity of the toner is measured by using a flow particle image measuring device ("FPIA-2100", manufactured by Sysmex Corporation) and calculated by using the following equation.

Equivalent circle diameter=(area of projected particle image/$\pi$)$^{1/2}\times2$ Circularity=(circumferential length of a circle having an area identical to that of a projected particle image)/(circumferential length of the projected particle image)

The "area of a projected particle image" refers to an area of a toner particle image binarized, and the "circumferential length of the projected particle image" is defined as a length of a profile line obtained by connecting edge points of the toner particle image. The circumferential length of the particle image obtained by image processing at an image processing resolution of 512×512 (0.3 μm×0.3 μm pixels) is used for the measurement.

The circularity according to the present invention is an index of a degree of unevenness of the toner particles. The circularity of 1.000 represents that the toner particles have a shape of a perfect sphere, and a small value of the circularity represents a complex surface shape of the toner.

The average circularity C, referring to an average of circularity frequency distribution, may be calculated by the following equation (2) using the circularity (central value) ci at a cutoff point (i) of the particle diameter distribution and the total particle number (m).

$$\text{Average circularity } C = \sum_{i=1}^{m} ci/m \qquad \text{(Equation 2)}$$

The measuring device "FPIA-2100" used in the present invention calculates the average circularity by the following method. That is, the method for calculation of the average circularity comprises: calculating circularity values of each of the particles, dividing the particles into classes equally divided by 0.01 in the circularity range of 0.4 to 1.0 according to the measured circularity, and determining the average circularity by using a central value of the circularity of each class and the measured number of particles of the class.

As a specific method for measuring the circularity, a surfactant, preferably alkylbenzenesulfonate, as a dispersant is added to 10 ml of ion-exchanged water with solid impurities removed, preliminarily prepared in a reaction vessel. Subsequently, 0.2 g of a sample to be measured is further added to this solution and uniformly dispersed. An ultrasonic disperser such as "Tetoral150" (manufactured by Nikkaki Bios Co., Ltd.) may be used as a dispersing means for subjecting the sample to 2-minute dispersion to prepare a dispersion for the measurement. At this time, temperature of the dispersion is arbitrary cooled so that the temperature does not increase to 40° C. or above. The environment around the device installed is controlled to 23° C.±0.5° C. so that temperature inside the flow particle image measuring device "FPIA-2100" becomes 26 to 27° C., to suppress variation in circularities. The device is automatically focused by using latex particles having size of 2-μm at regular time intervals, preferably every 2 hours.

The flow particle image measuring device is used for the circularity measurement of the toner particles, and 1,000 or more toner particles are measured by readjusting the dispersion concentration of the toner particles to 3,000 to 10,000 particles/μl as measured. After the measurement, the average circularity of the cyan toner is determined by using the data and omitting the data below equivalent circle diameter of 2 μm.

Further, the measuring device "FPIA-2100" used in the present invention has an increased measuring accuracy of the toner shape compared to "FPIA-1000" conventionally used for calculating the toner shape, through thinning of a sheathed flow (7 μm to 4 μm), enhancing of the magnification of processed particle images, and enhancing of the processing resolution of images captured in (256×256 to 512×512), thereby achieving more reliable trapping of fine particles. Therefore, when the particle shape must be more accurately measured as in the present invention, FPIA-2100 is more useful because of more accurate information regarding the particle shape being obtained.

(Measurement of the Reflectance and the Brightness of the Toner in a Powder Form)

Figure 2:
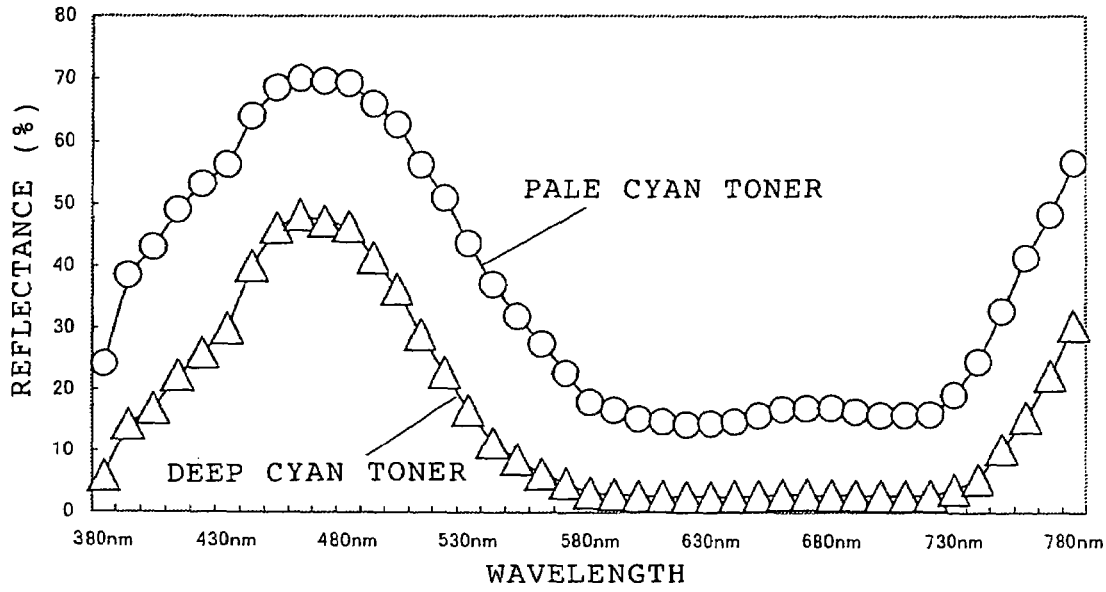
FIG. 2 is a diagram showing an example of measurement results of a spectroscopic analysis of a cyan toner of the present invention in a powder form and a deep cyan toner in a powder form having lower reflectance than the cyan toner.

The reflectance and the brightness of the cyan toner in a powder form is measured by using a spectral differential colorimeter ("SE-2000", manufactured by Nippon Denshoku Industries Co., Ltd.) according to JIS Z-8722 under illuminant conditions being illuminant C and standard colorimetric system. The measurement is carried out following the instruction attached to the device, but a reference plate is preferably standardized by using a glass of 2 mm thickness and 30 mm diameter in an optional measurement cell for powder. To be more specific, the measurement is carried out in a state where the cell filled with the sample powder is placed on a powder sample holder (attachment) of the spectral differential calorimeter. The reflectance and the brightness are measured by filling 80% or more of a cell inner volume with the powder sample and subjecting the sample to shaking of 1 cm shake width at 1 shake/second for 30 seconds on a shake table before placing on the powder sample holder. FIG. 2 shows a measurement result of spectral sensitivity distribution plotting the obtained reflectance on the vertical axis and a wavelength of the reflected light on the horizontal axis, using an example of the cyan toner in a powder form (pale cyan toner) of the present invention and an example of a deep cyan toner in a powder form having lower reflectance than the pale cyan toner. The reflectance at a wavelength of 500 nm and a wavelength of 600 nm can be easily determined by plotting a graph such as the result of FIG. 2.

(Measurement of the L*, a*, and b* Values of the Image)

The L*, a*, and b* values of the image are determined, for example, by: introducing the toner to a commercially-available full-color copying machine for plain paper ("CLC1150", manufactured by Canon Inc.), using plain papers ("TKCLA4", available from Canon Inc.) as an image receiving material; and measuring 200-line, 16-gradation images, formed by changing the toner amount on the paper, using SpectroScan Transmission (manufactured by Gretag-Macbeth Co., Ltd.). Hereinafter, an example of specific measurement conditions are shown.

Measurement Conditions

Figure 3:
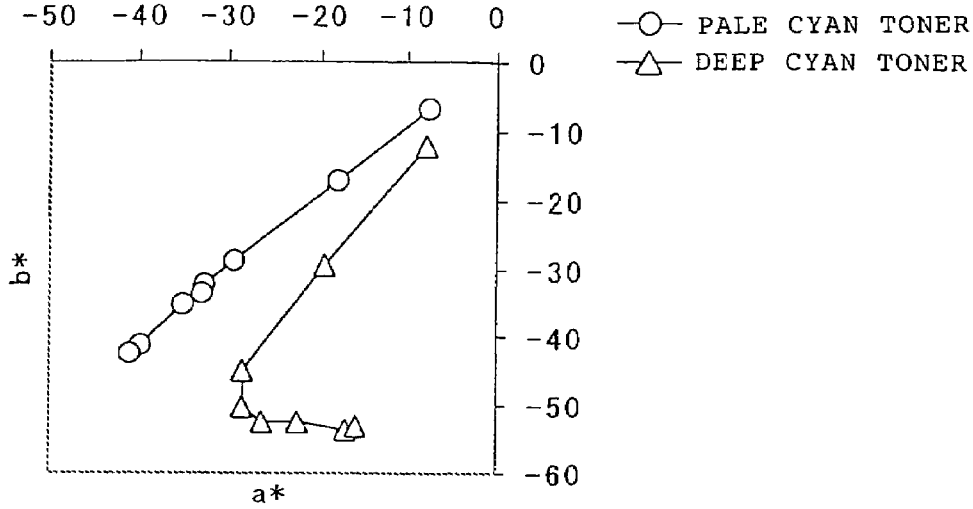
FIG. 3 is a diagram showing an example of a result of a hue measurement of an image formed by using a cyan toner of the present invention and a deep cyan toner having lower reflectance than the cyan toner.

Observation light source: D50
Observation visual field: 2°
Density: DIN NB
White reference: Pap
Filter: none FIG. 3 shows an a*-b* coordinate figure obtained by plotting the a* value on the horizontal axis and the b* value on the vertical axis measured by using an example of the pale cyan toner of the present invention and a deep cyan toner having lower reflectance than the pale cyan toner.

(Measurement of the Viscoelasticity of the Cyan Toner, Elastic Modulus $G'_{120}$ and $G'_{180}$)

The cyan toner is compressed into a disc sample having a diameter of 25 mm and a thickness of 2.5 mm. Then, the compressed sample is placed in a parallel plate and gradually heated within a temperature range of 50 to 200° C. for temperature dispersion measurement. The rate of temperature increase is set to 2° C./minutes and an angular frequency (ω) is fixed at 6.28 radians/seconds. Distortion rate is automatically controlled. The elastic modulus values at respective temperatures (120° C. and 180° C.) are read by plotting the temperature on the horizontal axis and the elastic modulus (G') on the vertical axis. A viscoelasticity-measurement apparatus ("ARES", manufactured by TA Instruments Japan Inc.) is used for the measurement.

(Measurement of the Deformation rate ($R_{200}$ and $R_{500}$) of the Cyan Toner)

The cyan toner is molded into a cylindrical sample having a diameter of 25 mm and a height of 10 to 11 mm by compressing 5 to 5.5 g of the toner at a pressure of $8.0\times10^6$ Pa for 2 minutes using a pellet molding machine. The viscoelasticity-measurement apparatus ("ARES", manufactured by TA Instruments Japan Inc.) provided with a parallel plate made of SUS, having a diameter of 25 mm, and coated with PTFE, is used for the measurement.

The deformation rate is measured by using the parallel plate having a diameter of 25 mm and coated with PTFE. The molded sample of the toner is placed on the parallel plate, and the temperature of a jig is controlled to 120° C. After confirming that the sample temperature reaches 120° C., a sample height (gap) is adjusted to 10.000 mm. Rate Mode Test is selected for Multiple Extension Mode Test, and the molded sample of the toner is compressed at a Rate of −0.5 mm/s to measure a relationship between the sample height (gap) and a load required for compressing the sample at a constant speed (referred to as Normal Force).

The deformation rate ($R_{200}$) of the toner can be calculated from the following equation (3) by using the sample height (gap) of $G_{200}$ mm at a Normal Force of load 200 g (pressure of $4.0\times10^3$ Pa).

$$R_{200} = \frac{10.000 - G_{200}}{10.000} \times 100 \quad \text{(Equation 3)}$$

Similarly, the deformation rate ($R_{500}$) of the toner can be calculated by using the sample height (gap) of $G_{500}$ mm at a Normal Force of load 500 g (pressure of $1.0\times10^4$ Pa).

EXAMPLES

Hereinafter, the present invention will be specifically described by way of production examples and examples, but those examples will not in any way restrict the present invention.

(Production Example of Hybrid Resin (I))

2.0 mol of styrene, 0.21 mol of 2-ethylhexylacrylate, 0.16 mol of fumaric acid, 0.03 mol of α-methylstyrene dimer, and 0.05 mol of dicumylperoxide as monomers for forming a vinyl copolymer unit were placed in a dropping funnel. Further, 7.0 mol of polyoxypropylene(2.2)-2,2-bis (4-hydroxyphenyl)propane, 3.0 mol of polyoxyethylene (2.2)-2,2-bis(4-hydroxyphenyl)propane, 3.0 mol of terephthalic acid, 2.0 mol of trimellitic acid anhydride, 5.0 fumaric acid, and 0.2 g of dibutyltin oxide as monomers for forming a polyester unit were placed in a 4L four-necked flask made of glass. A thermometer, a stirring rod, a condenser, and a nitrogen-introducing tube were attached to the four-necked flask, and the four-necked flask was placed in a mantle heater. After air in the four-necked flask was replaced with nitrogen gas, the mixture was gradually heated under stirring. Stirring at 140° C., the monomers of the vinyl copolymer and a polymerization initiator were dropped from the dropping funnel over 4 hours. Then, the mixture was heated to 200° C. for a reaction for 4 hours, to thereby obtain a hybrid resin (I). Table 1 shows results of molecular weight measurement of the hybrid resin (I) by GPC.

(Production Example of Polyester Resin (I))

3.5 mol of polyoxypropylene(2.2)-2,2-bis (4-hydroxyphenyl)propane, 1.5 mol of polyoxyethylene(2.2)-2,2-bis(4-hydroxyphenyl)propane, 1.5 mol of terephthalic acid, 1.0 mol of trimellitic acid anhydride, 2.5 mol of fumaric acid, and 0.1 g of dibutyltin oxide were placed in a 4L four-necked flask made of glass. A thermometer, a stirring rod, a condenser, and a nitrogen-introducing tube were attached to the four-necked flask, and the four-necked flask was placed in a mantle heater. The mixture was reacted at 220° C. for 5 hours under a nitrogen atmosphere, to thereby obtain a polyester resin (I). Table 1 shows results of molecular weight measurement of the polyester resin (I) by GPC.

(Production Example of Polyester Resin (II))

2.5 mol of polyoxypropylene(2.2)-2,2-bis (4-hydroxyphenyl)propane, 1.5 mol of polyoxyethylene(2.2)-2,2-bis(4-hydroxyphenyl)propane, 1.5 mol of terephthalic acid, 5.0 mol of trimellitic acid anhydride, 2.5 mol of fumaric acid, and 0.1 g of dibutyltin oxide were placed in a 4L four-necked flask made of glass. A thermometer, a stirring rod, a condenser, and a nitrogen-introducing tube were attached to the four-necked flask, and the four-necked flask was placed in a mantle heater. The mixture was reacted at 220° C. for 5 hours under a nitrogen atmosphere, to thereby obtain a polyester resin (II). Table 1 shows results of molecular weight measurement of the polyester resin (II) by GPC.

(Production Example of Polyester Resin (III))

5.0 mol of polyoxypropylene(2.2)-2,2-bis (4-hydroxyphenyl)propane, 2.5 mol of terephthalic acid, 2.5 mol of fumaric acid, and 0.1 g of dibutyltin oxide were placed in a 4L four-necked flask made of glass. A thermometer, a stirring rod, a condenser, and a nitrogen-introducing tube were attached to the four-necked flask, and the four-necked flask was placed in a mantle heater. The mixture was reacted at 220° C. for 5 hours under a nitrogen atmosphere, to thereby obtain a polyester resin (III). Table 1 shows results of molecular weight measurement of the polyester resin (III) by GPC.

| (Production example of vinyl copolymer (I)) | |
|---|---|
| Styrene | 70 parts by mass |
| n-Butyl acrylate | 24 parts by mass |
| Monobutyl maleate | 6 parts by mass |
| 2,2-Bis(4,4-di-t-butylperoxycyclohexyl)propane | 1 part by mass |

200 parts by mass of xylene was placed into a four-necked flask. Then, the air in the flask was sufficiently replaced by nitrogen while stirring the xylene. After heating the xylene to 120° C., each of the above components was dropped into the four-necked flask over 3.5 hours. Further, polymerization was completed under reflux of xylene and the solvent was distilled off, to thereby obtain a vinyl copolymer (I). Table 1 shows results of molecular weight measurement of the vinyl copolymer (I) by GPC.

TABLE 1

(Production of masterbatch of wax dispersant)

| Resin type | Mw | Mn | Mw/Mn |
|---|---|---|---|
| Hybrid resin (I) | 68,000 | 3,400 | 20.00 |
| Polyester resin (I) | 32,000 | 2,800 | 11.43 |
| Polyester resin (II) | 85,000 | 3,300 | 25.76 |
| Polyester resin (III) | 5,200 | 2,200 | 2.36 |
| Vinyl copolymer (I) | 285,000 | 6,500 | 43.85 |

Next, production procedures of a wax dispersant and a masterbatch of wax dispersant will be described below.

600 parts by mass of xylene and 120 parts by mass of polyethylene with low-density having the maximal value of the maximum heat-absorption peak temperature of 110° C. were placed in a reaction vessel of an autoclave provided with a thermometer and a stirrer and sufficiently dissolved. After replacing the air in the autoclave with nitrogen, a mixed solution of 1,992 parts by mass of styrene, 168 parts by mass of acrylonitrile, 240 parts by mass of monobutyl maleate, 78 parts by mass of di-t-butylperoxy hexahydroterephthalate, and 455 parts by mass of xylene was dropped into the reaction vessel at 175° C. over 3 hours. The solution was maintained at this temperature for 30 minutes for polymerization. Then, desolvating was performed, to thereby obtain a wax dispersion medium (I), which is a graft reaction product.

Table 2 shows molecular weight of the wax dispersion medium by GPC and the maximal value of the maximum heat-absorption peak temperature of the polyethylene with low-density by DSC. Components of the wax dispersion mediums (II) and (III) are the same as those of the wax dispersion medium (I), and the components of the wax dispersion medium (IV) are the same as those of the wax dispersion medium (I) except that acrylonitrile was not used.

TABLE 2

| Kinds of wax | Mw | Mn | Mw/Mn | maximal value of maximum heat-adsorption peaks of polyolefin |
|---|---|---|---|---|
| Wax dispersion medium(I) | 15,000 | 3,000 | 5.0 | 110° C. |
| Wax dispersion medium(II) | 80,000 | 5,000 | 16.0 | 90° C. |
| Wax dispersion medium(III) | 20,000 | 1,800 | 11.0 | 128° C. |
| Wax dispersion medium(IV) | 16,000 | 3,200 | 5.0 | 110° C. |

Next, a wax (A), which is a purified normal paraffin wax, was dispersed in the wax dispersion medium (I) according to the following blending ratio, to thereby obtain a wax dispersant (I) consisting of the wax (A) and the wax dispersion medium (I). Table 3 shows kinds and the maximal values of the maximum heat-absorption peak temperatures of the waxes used in the examples of the present invention.

TABLE 3

| | maximal value of maximum heat-adsorption peaks | Kinds of wax | Mw | Mn |
|---|---|---|---|---|
| Wax (A) | 75° C. | Purified normal paraffin | 500 | 380 |
| Wax (B) | 98° C. | Purified Fischer-Tropsch | 910 | 590 |
| WAX (C) | 83° C. | Carnauba | 500 | 390 |
| Wax (D) | 110° C. | Polyethylene | 8880 | 1010 |
| Wax (E) | 63° C. | Purified normal paraffin | 320 | 280 |
| Wax (F) | 68° C. | Purified normal paraffin | 360 | 330 |
| Wax (G) | 102° C. | Purified Fischer-Tropsch | 1120 | 780 |

The wax dispersant (I) thus obtained was melt-kneaded with the polyester resin (I) by using a twin screw extruder according to the following blending ratio, to thereby obtain a masterbatch of wax dispersant (I) containing the wax (A).

| | |
|---|---|
| Wax (A) dispersant (I) | 50% by mass |
| Polyester resin (I) | 50% by mass |

Example 1

(First Kneading Step)

| | |
|---|---|
| Polyester resin (I) | 70 parts by mass |
| Pasty colorant containing C.I. Pigment Blue 15:3 and C.I. Pigment Green 7 | 75 parts by mass (30 parts by mass as a colorant) |

The above raw materials were charged in a kneader-type mixer following the above recipe and were heated without pressure while mixing. Pigments in an aqueous phase distributed or shifted to a molten resin phase at the time when the mixture reached the maximum temperature (naturally determined by the boiling point of a solvent in the paste, about 90 to 100° C. in this case). After the distribution or the shift of the pigments was confirmed, the mixture was further heat-melt-kneaded for 30 minutes to sufficiently shift the colorant from the paste. Then, the mixer was stopped once, and hot water was discharged. The mixture was further heated to 130° C., further heat-melt-kneaded for about 30 minutes to disperse the colorant while distilling off the water content, and cooled, to thereby take 100 parts by mass of a first kneaded product (I) out.

The pasty colorant contains two or more kinds of the colorants and is a pasty colorant mixture obtained without drying a colorant from a colorant slurry produced by a known production method. The pasty colorant is a composition containing 40% by mass of solid content and 60% by mass of water. The solid composition of the pasty colorant according to the first kneaded product (I) includes 86% by mass of the C.I. Pigment Blue 15:3 and 14% by mass of the C.I. Pigment Green 7.

| | |
|---|---|
| Hybrid resin (I) | 100 parts by mass |
| First kneaded product (I) | 2.55 parts by mass |
| Masterbatch of wax dispersant (I) containing wax (A) | 16 parts by mass (4 parts by mass as wax (A)) |
| Aluminum di-t-butyl salicylate compound | 2 parts by mass |

The above materials were sufficiently premixed by using a Henschel mixer and melt-kneaded at an arbitrary barrel temperature by using a twin screw extruder. After cooling, the mixture was coarsely pulverized to about 1 to 2 mm by using a hammer mill and then finely pulverized by using an air-jet type fine pulverizer. The finely pulverized product was treated by using a surface modification device for classification and surface modification utilizing mechanical impact force, to thereby obtain toner particles having an average circularity of 0.930 for particles with equivalent circle diameters of 2 μm or larger. 1.5 parts by mass of titanium oxide fine powder, having a primary particle diameter of 50 nm and surface-treated with isobutyl trimethoxysilane, was externally added to and mixed with 100 parts by mass of the toner particles, to thereby obtain a pale cyan toner a-1 having a weight average particle diameter of 6.5 μm.

The cyan toner a-1 and magnetic ferrite carrier having n average particle diameter of 42 μm and surface-coated with a silicone resin, were mixed so that the toner concentration was 6% by mass, to thereby prepare a cyan developer a-1 (pale).

A commercially-available full-color copying machine for plain paper ("CLC1150", manufactured by Canon Inc.) remodeled by removing a fixing unit was used as apparatus for forming an image. The apparatus is arranged with four developing units around one photoconductive member and is provided with a transfer drum. Images are formed by sequentially developing, with each developing unit repeatedly approaching to and separating from the photosensitive drum, and sequentially transferring the images to a transfer material supported on the transfer drum to thereby perform image formation. The cyan developer a-1 was set in the cyan developing unit of the apparatus. Using a plain paper ("TKCLA4", available from by Canon Inc.) as a transfer material, a 16-gradation unfixed patch image of the cyan toner a-1 was formed with a printer mode.

The unfixed image was fixed onto TKCLA4 by using fixing rollers having a rubber layer of 1.5 mm thickness as a substrate and a surface layer wrapped with a PFA tube having a thickness of 50 μm, and using a remodeled external fixing device in which a linear pressure was adjusted such that a nip width between the top and the bottom fixing rollers was 11 mm.

An image with an optical density of about 0.35 in a low-density region was extracted. A 256×256 pixel area of the halftone patch of the image was read at resolution of 1,000 dpi by using a drum scanner, and RGB value of the area was converted into brightness (L*).

Then, L* value data was converted into spatial frequency by Fourier transformation. The spatial frequency was multiplied by visual spatial frequency characteristics (VTF) for conversion into a visual frequency information, and then integrated with the whole frequency band, which was then defined as roughness. If an image patch with an optical density of 0.35 was unavailable, the brightness of the image with an optical density of 0.35 was calculated by using data on several points with optical densities around 0.35.

Graininess (roughness) of those images was evaluated according to rank based on the following criteria.

A: below 22.0 (no roughness at all, very good graininess)
B: 22.1 to 24.0 (practically no roughness, good graininess)
C: 24.1 to 26.0 (slight roughness, graininess not posing problems in practical use)
D: 26.1 to 28.0 (apparent roughness, poor graininess)
E: 28.1 or above (much roughness, very poor graininess)

An OHP sheet was used instead of the plain paper to fix the unfixed image similarly output by using the remodeled external fixing device. Transmittance of the OHP sheet and an image formed on the OHP sheet were measured to determine transparency on the OHP sheet. Shimadzu recording spectrophotometer (UV2200, manufactured by Shimadzu Corporation) was used for measurement of the transmittance. The transmittance of the OHP sheet alone was defined as 100% to measure and evaluate the transmittance of the cyan toner at the maximum-absorbance wavelength of 500 nm. Evaluation criteria of transparency are described below.

A: 70% or above (very good transparency)
B: 60% to below 70% (good transparency)
C: 50% to below 60% (transparency not posing problems in practical use)
D: 40% to below 50% (somewhat poor transparency)
E: below 40% (very poor transparency).

The unfixed image was fixed with the remodeled external fixing device by using a plain paper and manually changing a set temperature to measure a fixing temperature range with a fixing start temperature as a lower limit and an offset starting temperature as an upper limit.

The cyan developer a-1 was introduced to a full-color copying machine for plain paper ("CLC1150", manufactured by Canon Inc.) and 200-line, 16-gradation images were formed by using the above plain paper ("TKCLA4", available from by Canon Inc.) and changing the toner amount on the paper. L* and c* (chroma) values of the obtained image were measured by using SpectroScan Transmission (manufactured by GretagMacbeth Co., Ltd.) to evaluate the c* value on the L*-c* coordinate at L*=80. The evaluation criteria thereof are described below.

A: 29 or above (very good chroma)
B: 27 to below 29 (good chroma)
C: 25 to below 27 (chroma not posing problems in practical use)
D: 23 to below 25 (somewhat poor chroma)
E: below 23 (very poor chroma)

Table 4 and Table 5 show: kind of the binder resin; kind of the wax (including wax dispersant); kind, content, number % of the pigments having dispersion diameters of 0.05 to 0.5 μm of the colorant; average circularity, and maximal value of maximum heat-absorption peak temperature of the toner by DSC. Table 6 shows measurement results of spectral sensitivity (reflectance measurement values at light of 500 nm and 600 nm wavelength) of the toner, L* value thereof, viscoelasticity thereof, and toner deformation rate. Further, Table 7 shows evaluation results of: roughness of the patch image with an optical density of about 0.35 when using pale cyan toner alone and of the patch image with an optical density of about 0.8 when using both the pale cyan toner and the deep cyan toner in combination; fixing temperature region; transparency on an OHP sheet; and c* value at L*=80.

The cyan developer of this example proved adequate for practical use in terms of all of roughness, fixing temperature region, transparency on the OHP sheet, and chroma.

Example 2

A cyan toner a-2 was prepared in the same way of Example 1 except that a masterbatch of wax dispersant containing a wax (F) and a wax dispersion medium (II) was used instead of the masterbatch of wax dispersant (I), to thereby obtain a cyan developer a-2. The cyan developer a-2 was evaluated in the same way of Example 1. Table 7 shows that the cyan developer a-2 had better low-temperature fixability and slightly poor high-temperature offset property compared to those of Example 1 but was within an adequately practical level.

Example 3

A cyan toner a-3 was prepared in the same way of Example 1 except that a masterbatch of wax dispersant containing a wax (G) and a wax dispersion medium (III) was used instead of the masterbatch of wax dispersant (I), to thereby obtain a cyan developer a-3. The cyan developer a-3 was evaluated in the same way of Example 1. Table 7 shows that the cyan developer a-3 had better high-temperature anti-offset property and slightly poor low-temperature fixability compared to that of Example 1 but was within an adequately practical level.

Example 4

A cyan toner a-4 was prepared in the same way of Example 1 except that a masterbatch of wax dispersion containing a wax (B) and a wax dispersion medium (I) was used instead of the masterbatch of wax dispersant (I) and content of the C.I. Pigment Blue 15:3 was changed to 0.8 parts by mass, to thereby obtain a cyan developer a-4. The cyan developer a-4 was evaluated in the same way of Example 1. Table 7 shows that the cyan developer a-4 had slightly poor low-temperature fixability compared to that of Example 1 but was within an adequately practical level.

Example 5

A cyan toner a-5 was prepared in the same way of Example 1 except that the wax (A) alone was used instead of the masterbatch of wax dispersant (I) and the C.I. Pigment Blue 15:3 alone was used as a colorant with an amount of 0.7 parts by mass, to thereby obtain a cyan developer a-5. The cyan developer a-5 was evaluated in the same way of Example 1. Table 7 shows that the cyan developer a-5 had slightly poor roughness and transparency on an OHP sheet compared to that of Example 1 but was within an adequately practical level.

Example 6

A cyan toner a-6 was prepared in the same way of Example 1 except that the polyester resin (I) alone was used as a binder resin, a masterbatch of wax dispersant containing a wax (A) and a wax dispersion medium (IV) was used instead of the masterbatch of wax dispersant (I), and that the C.I. Pigment Blue 15:3 alone was used as a colorant with an amount of 1.8 parts by mass, to thereby obtain a cyan developer a-6. The cyan developer a-6 was evaluated in the same way of Example 1. Table 7 shows that the cyan developer a-6 had slightly poor roughness, transparency on an OHP sheet, and chroma compared to that of Example 1 but was within a practical level.

Example 7

A cyan toner a-7 was prepared in the same way of Example 1 except that a mixture containing a hybrid resin (I) and a vinyl copolymer atch, to thereby obtain a cyan developer a-7. The cyan developer a-7 was evaluated in the same way of Example 1. Table 7 shows that the cyan developer a-7 had poor transparency on an OHP sheet, fixing temperature range width, roughness, and chroma compared to that of Example 1 but was within a practical level.

Example 8

A cyan toner a-8 was prepared substantially in the same way of Example 1 except that a mixture containing the hybrid resin (I) and the polyester resin (I) in a ratio of 1:1 was used as a binder resin, a wax (C) alone was used instead of the masterbatch of wax dispersant (I), and the C.I. Pigment Blue 15:3 alone was used with an amount of 0.7 parts by mass, to thereby obtain a cyan developer a-8. The cyan developer a-8 was evaluated in the same way of Example 1. Table 7 shows that the cyan developer a-8 had poor roughness, fixing temperature range width, or transparency on an OHP sheet, and chroma compared to that of Example 1 but was within a lower limit of a practical level for all items.

Example 9

A cyan toner a-9 was prepared in the same way of Example 1 except that a vinyl copolymer (I) was used as a binder resin, the wax dispersant (I) alone, which contains wax (A) without masterbatching, was used, content of the C.I. Pigment Blue 15:3 was changed to 0.3 parts by mass, and a combining colorant was changed to C.I. Pigment Yellow 180, a yellow colorant, with an amount of 0.1 parts by mass, to thereby obtain a cyan developer a-9. The cyan developer a-9 was evaluated in the same way of Example 1. Table 7 shows that the cyan developer a-9 had low gloss and rather poor chroma, transparency on an OHP sheet, fixing temperature range width, and roughness compared to that of Example 1, since a vinyl copolymer alone was used, but was within an lower limit of a practical level even combined with the yellow colorant.

Example 10

A cyan toner a-10 was prepared in the same way of Example 1 except that a mixture of the polyester resin (I) and the vinyl copolymer (I) in a ratio of 7:3 was used as a binder resin, a combining colorant with the C.I. Pigment Blue 15:3 was changed to C.I. Pigment Red 122, a red colorant, and wax dispersant containing the wax (A) and a wax dispersion medium (II) and without masterbatching was used instead of masterbatch of the wax dispersant (I), to thereby obtain a cyan developer a-10. The cyan developer a-10 was evaluated in the same way of Example 1. Table 7 shows that the cyan developer a-10 had rather poor roughness, fixing temperature range width, transparency on an OHP sheet, and chroma compared to that of Example 1 but was within a practical level even combined with the red colorant.

Example 11

A cyan toner a-11 was prepared in the same way of Example 1 except that a mixture of the hybrid resin (I), the polyester resin (I), and a vinyl copolymer (I) in a ratio of 5:3:2 was used as a binder resin and a wax dispersant without masterbatching was used instead of the masterbatch of wax dispersant (I), to thereby obtain a cyan developer a-11. The cyan developer a-11 was evaluated in the same way of Example 1. Table 7 shows that the cyan developer a-11 had rather poor roughness, fixing temperature range width, transparency on an OHP sheet, and chroma compared to that of Example 1 but was within a practical level.

Comparative Example 1

A cyan toner a-12 was prepared in the same way of Example 1 except that a wax used was changed to a wax (D), the polyester resin (I) alone was used as a binder resin, and the C.I. Pigment Blue 15:3 alone was used as a colorant with an amount of 0.4 parts by mass, to thereby obtain a cyan developer a-12. The cyan developer a-12 was evaluated in the same way of Example 1. The cyan developer a-12 had increased roughness, thereby providing an image with very conspicuous graininess in the low-density region. Further, more toner must be loaded compared to Example 1 and the cyan developer a-12 resulted in very poor fixing temperature range width, transparency on an OHP sheet, and chroma compared to that of Example 1.

Comparative Example 2

A cyan toner a-13 was prepared in the same way of Example 1 except that a wax used was changed to a wax (E), a polyester resin (III) alone was used as a binder resin, and the C.I. Pigment Blue 15:3 alone was used as a colorant with an amount of 0.4 parts by mass, to thereby obtain a cyan developer a-13. The cyan developer a-13 was evaluated in the same way of Example 1. During the conglobation of the toner using a surface modification device shown in FIG. 4, exposure of the wax to a toner surface progressed, thereby and transfer efficiency reduced. As a result, roughness increased and graininess in the low-density region was very poor compared to that of Example 1. Further, the cyan developer a-13 had very poor fixing temperature range width and transparency on an OHP sheet compared to that of Example 1.

Comparative Example 3

A cyan toner a-14 was prepared in the same way of Example 1 except that a wax used was changed to a wax (D) instead of a masterbatch of wax dispersant (I) and the C.I. Pigment Blue 15:3 alone was used as a colorant with an amount of 1.2 parts by mass, to thereby obtain a cyan developer a-14. The cyan developer a-14 was evaluated in the same way of Example 1. Roughness of the obtained image in low-density region was very large, and fixing temperature range width and transparency on an OHP sheet were poor compared to that of Example 1.

Example 12

A cyan toner b-1 (deep cyan toner) was prepared in the same way of Example 1 except that the C.I. Pigment Blue 15:3 alone was used as a colorant with an amount of 5.0 parts by mass. Reflectance of the cyan toner b-1 in a powder form measured by using light at a wavelength of 500 nm was 28.3%, and reflectance measured by using light at a wavelength of 600 nm was 4.3%. An L* value was 37.9%.

The cyan toner b-1 and ferrite carrier (average particle diameter of 42 μm) with its surface coated with a silicone resin were mixed so that toner concentration was 6% by mass, to thereby obtain a cyan developer b-1 (deep)

Figure 11:
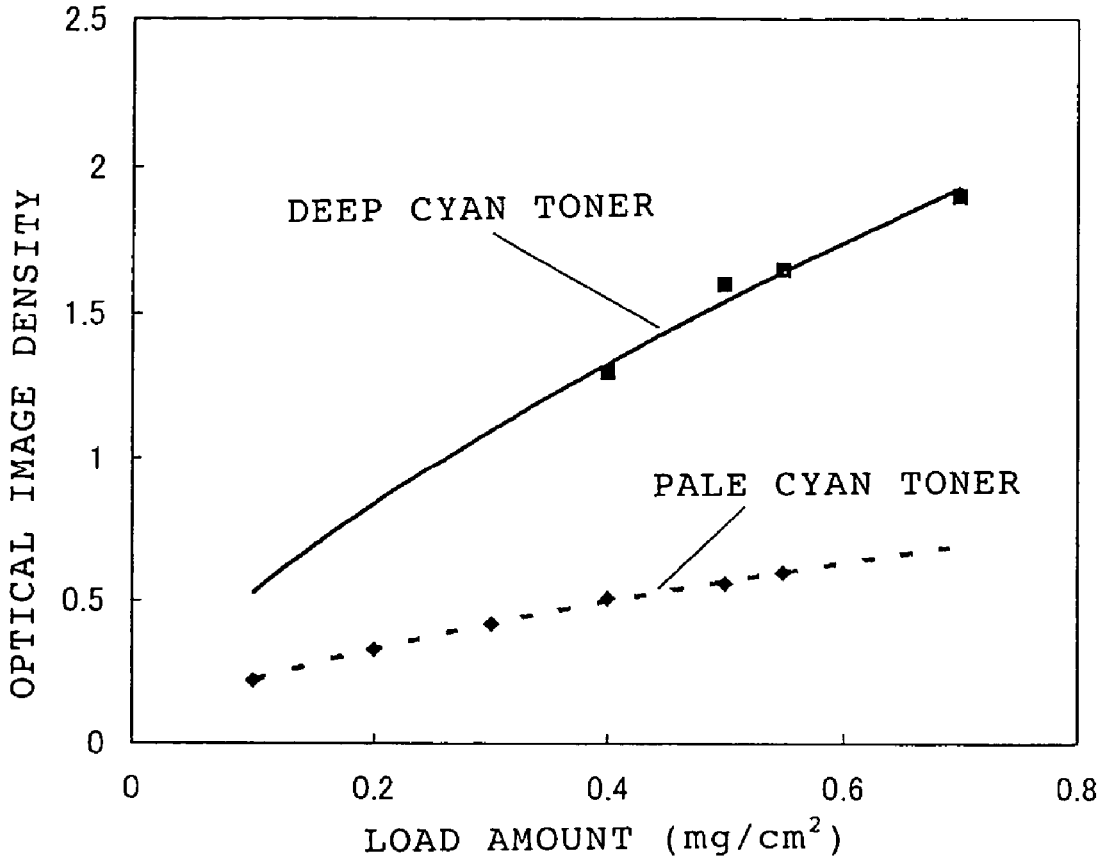
FIG. 11 is a diagram showing a relationship between a toner amount loaded on a fixed image and an optical image density of the fixed image.

The deep cyan toner and the pale cyan toner used in combination suppress roughness, providing an image with excellent reproduction of halftones. The reason is described below. FIG. 11 shows relationships between a toner amount loaded on the fixed image and optical image density of the fixed image, which are obtained by using deep cyan toner b-1 and pale cyan toner a-1 independently.

For Examples 1 to 11, roughness was evaluated for images with an optical density of about 0.35 when the pale cyan toner alone was used. On the other hand, the pale cyan toner and the deep cyan toner were used in Example 12, enabling reproduction of higher image density. Therefore, roughness of an image in a halftone region with an optical density of about 0.80, hardly attained with the pale cyan toner alone, was evaluated. Hereinafter, evaluation method will be described.

In a commercially-available full-color copying machine for plain paper ("CLC1150", manufactured by Canon Inc.), the cyan developer a-1 containing the cyan toner a-1 was charged in the cyan developing unit and the cyan developer b-1 containing the cyan toner b-1 was charged in the magenta developing unit. A patch image overlapping a 16-gradation pale cyan toner image and a 16-gradation deep cyan toner image with an image pattern obtained by rotating the image pattern of the pale cyan toner by 90 degrees was formed in a printer mode, by using plain paper ("TKCLA4", available from by Canon Inc.).

Roughness of the image obtained by using the pale cyan developer and the deep color cyan developer in combination was evaluated according to rank based on the following criteria.

A: below 32.0 (no roughness at all, very good graininess)
B: 32.1 to 34.0 (practically no roughness, good graininess)
C: 34.1 to 36.0 (slight roughness, graininess not posing problems in practical use)
D: 36.1 to 38.0 (apparent roughness, poor graininess)
E: 38.1 or above (much roughness, very poor graininess)

Roughness of the patch image at an optical density of about 0.80 obtained by using a combination of the cyan toner a-1 as a pale toner and the cyan toner b-1 as a deep toner, was measured for Example 12. Table 7 shows that the combined toner had slightly poor transparency on an OHP sheet, fixing temperature range width, and chroma compared to the pale toner alone, but will not pose problems in practical use. The image overlaid with two colors resulted in a roughness value of 30.5 at an optical density of about 0.80. The result is much better than the cyan toner b-1 alone at an optical density of about 0.80, having a roughness value of 42.3.

Examples 13 to 22

For Examples 13 to 22, the deep toner was fixed to the cyan toner b-1 and a combining pale toner was sequentially changed from cyan toners a-2 to a-11. The combined toners were evaluated in the same way of Example 12. Table 7 shows that the combined toners had poor roughness at an optical density of about 0.80, transparency on an OHP sheet, fixing temperature range width, and chroma compared to the toner of Example 12, but not posing any problems in practical use.

Examples 23

A cyan toner b-2 was prepared in the same way of Example 1 except that the C.I. Pigment Blue 15:3 alone was used as a colorant with an amount of 8.0 parts by mass. Reflectance of the cyan toner b-2 in a powder form measured by using light at a wavelength of 500 nm was 23.1%, and reflectance measured by using light at a wavelength of 600 nm was 2.3%. An L* value was 34.5%. In the same way of Example 12, a patch image was formed by using the cyan developer b-2 and the cyan developer a-1.

The patch image was evaluated in the same way of Example 12. Table 7 shows that the patch image had poor transparency on an OHP sheet, fixing temperature range width, and chroma compared to the image obtained by using the pale toner alone, but not posing any problems in practical use. Roughness of the image overlaid with two colors was 33.1, within a practical level.

Example 24

A cyan toner b-3 was prepared in the same way of Example 1 except that the C.I. Pigment Blue 15:3 alone was used as a colorant with an amount of 3.0 parts by mass. Reflectance of the cyan toner b-3 in a powder form measured by using light at a wavelength of 500 nm was 44.1%, and reflectance measured by using light at a wavelength of 600 nm was 4.8%. An L* value was 43.9%. In the same way of Example 12, a patch image was formed by using the cyan developer b-3 (deep) and the cyan developer a-1 (pale).

The patch image was evaluated in the same way of Example 12. Table 7 shows that the patch image had poor transparency on an OHP sheet, fixing temperature range width, and chroma compared to the image obtained by using the pale toner alone, but not posing any problems in practical use. Roughness of the image overlaid with two colors was 33.9, within a practical level.

Example 25

In the same way of Example 12, a patch image was formed by using the cyan developer a-8 and the cyan developer b-2. The patch image was evaluated in the same way of Example 12. Table 7 shows that the patch image had poor transparency on an OHP sheet, fixing temperature range width, and chroma compared to the image obtained by using the pale toner alone, but not posing any problems in practical use. Roughness of the image overlaid with two colors was 35.2, within a lower limit of a practical level.

Example 26

Evaluation was performed by a one-component developing method using the cyan developer a-1 and the cyan developer b-1. A device remodeled by removing a fixing unit from LBP-2040 (manufactured by Canon Inc.) was used as an apparatus for forming an image, and fixing was conducted by using an external fixing device similar to that of Example 1. Table 7 shows that the image obtained had no problems in transparency on an OHP sheet, fixing temperature range width, and chroma in the same way of the image in Example 12. Roughness of the image overlaid with two colors overlaying was 31.8, comparable to that of the image formed by a two-component developing method.

Example 27

In Example 27, an image was formed by using a full-color electrophotography device shown in FIG. 6 with a combination of the developing units and the developers represented in (a) to (c) below. Significant differences between the combinations of the developers represented by (a) to (c) were investigated by using the electrophotography device shown in FIG. 6.

(a): respectively using the deep cyan developer (cyan developer b-1 used in Example 12) for a developing unit 411*a*; a magenta developer containing 6.0 parts by mass of Pigment Red 122 added, instead of the colorant in the toner of Example 1 for a developing unit 412; a yellow developer containing 8.0 parts by mass of Pigment Yellow 180 added, instead of the colorant in the toner of Example 1 for a developing unit 413; and a black developer containing 4.0 parts by mass of carbon black added, instead of the colorant in the toner of Example 1 for a developing unit 414.

(b): respectively using the deep cyan developer (cyan developer b-1) for a developing unit 411*a*; the pale cyan developer (cyan developer a-1) for a developing unit 411*b*; the above magenta developer for the developing unit 412; the above yellow developer for the developing unit 413; and the above black developer for the developing unit 414.

(c): respectively using the pale cyan developer (cyan developer a-1) for the developing unit 411*b*; the above magenta developer for the developing unit 412; the above yellow developer for the developing unit 413; and the above black developer for the developing unit 414.

As a result, a vivid image was obtained by using combination (b), the image having suppressed graininess and roughness across the whole region from the low-density region to the high-density region and exhibiting high chroma compared to the image using combination (a). On the other hand, an image obtained by using combination (c) had reduced graininess in the low-density region and increased color reproduction range, but had reduced chroma from the medium-density region to the high-density region. Further, combination (c) resulted in an image with increased graininess in the medium-density region compared to the image using combination (a). That is, effect of the present invention was also sufficiently exhibited for the full-color electrophotography device as in Example 27 by using the pale cyan toner and the deep cyan toner within the range of the present invention.

Comparative Example 4

A cyan toner b-4 was prepared in the same way of Example 1 except that a wax (D) was used instead of the masterbatch of wax dispersant (I) and the C.I. Pigment Blue 15:3 alone was used as a colorant with an amount of 2.2 parts by mass. Reflectance of the cyan toner b-4 in a powder form measured by using light at a wavelength of 500 nm was 38.2%, and reflectance measured by using light at a wavelength of 600 nm was 4.2%. An L* value was 40.9%.

In the same way of Example 12, a patch image was formed by using the cyan developer b-4 and the cyan developer a-4. A difference between the L* values of the pale cyan toner a-4 and the deep cyan toner b-4 was as small as 6.0%. The patch image was evaluated in the same way of Example 12. Roughness of the image at the medium-density region (density of about 0.80) was measured, resulting in a very poor value of 37.5 with two colors overlaid. Thus, the total amount of the toner loaded was also large, resulting in a very narrow fixing temperature range width.

Comparative Example 5

A cyan toner b-5 was prepared in the same way of Example 1 except that a wax (D) was used instead of the masterbatch of wax dispersant (I) and the C.I. Pigment Blue 15:3 alone was used as a colorant with an amount of 9.0 parts by mass. Reflectance of the cyan toner b-5 in a powder form measured by using light at a wavelength of 500 nm was 22.2%, and reflectance measured by using light at a wavelength of 600 nm was 1.9%. An L* value was 29.5%.

In the same way of Example 12, a patch image was formed by using the cyan developer b-5 and the cyan developer a-1. A difference between the L* values of the pale cyan toner a-1 and the deep cyan toner b-5 was as large as 34.4%. The patch image was evaluated in-the same way of Example 12. Roughness of the image at the medium-density region (density of about 0.80) was measured, resulting in a very poor value of 38.1 with two colors overlaid. Further, transparency on an OHP sheet and chroma were also very poor.

Comparative Example 6

In the same way of Example 12, a patch image was formed by using the cyan developer a-6 and the cyan developer b-3. A difference between the L* values of the pale cyan toner a-6 and the deep cyan toner b-3 was as very small as 3.8%. The patch image was evaluated in the same way of Example 12. Roughness of the image at the medium-density region (density of about 0.80) was measured, resulting in a very poor value of 38.2 with two colors overlaid. Thus, the total amount of the toner loaded was also rather large, resulting in a narrow fixing temperature range width. Further, transparency on an OHP sheet and chroma were also very poor.

TABLE 4

| Toner No. | Binder resin Kind | Wax (Wax duspersant) Kind | Maximal value of maximum heat-adsorption peaks (° C.) | Average circularity | Colorant Kind | Colorant content (parts by mass) | Colorant Ratio of particles having dispersion sizes of 0.05 to 0.5 μm (number %) |
|---|---|---|---|---|---|---|---|
| Toner a-1 | Hybrid resin (I) | Masterbatch of wax dispersant (I) containing wax (A) and wax dispersion medium (I) | 77 | 0.930 | C.I.Pig.Blue 15:3/C.I.Pig. Green 7 | 0.6/0.1 | 80.2 |
| Toner a-2 | Hybrid resin (I) | Masterbatch of wax dispersant containing wax (F) and wax dispersion medium (II) | 69 | 0.928 | C.I.Pig.Blue 15:3/C.I.Pig. Green 7 | 0.6/0.1 | 78.9 |

TABLE 4-continued

| Toner No. | Binder resin Kind | Wax (Wax duspersant) Kind | Maximal value of maximum heat-adsorption peaks (° C.) | Average circularity | Colorant Kind | Colorant content (parts by mass) | Colorant Ratio of particles having dispersion sizes of 0.05 to 0.5 μm (number %) |
|---|---|---|---|---|---|---|---|
| Toner a-3 | Hybrid resin (I) | Masterbatch of wax dispersant containing wax (G) and wax dispersion medium (III). | 104 | 0.931 | C.I.Pig.Blue 15:3/C.I.Pig. Green 7 | 0.6/0.1 | 79.6 |
| Toner a-4 | Hybrid resin (I) | Masterbatch of wax dispersant containing wax (B) and wax dispersion medium (I) | 99 | 0.935 | C.I.Pig.Blue 15:3/C.I.Pig. Green 7 | 0.8/0.1 | 78.6 |
| Toner a-5 | Hybrid resin (I) | Wax (A) | 78 | 0.940 | C.I.Pig.Blue 15:3 | 0.7 | 71.2 |
| Toner a-6 | Polyester resin (I) | Masterbatch of wax dispersant containing wax (A) and wax dispersion medium (IV) | 78 | 0.938 | C.I.Pig.Blue 15:3 | 1.8 | 74.8 |
| Toner a-7 | Hybrid resin (I): Vinyl copolymer (I) = 7:3 | Wax (B) | 99 | 0.935 | C.I.Pig.Blue 15:3/C.I.Pig. Green 7 | 0.6/0.1 | 72.3 |
| Toner a-8 | Hybrid resin (I): Polyester resin (I) = 1:1 | Wax (C) | 85 | 0.927 | C.I.Pig.Blue 15:3 | 0.7 | 71.5 |
| Toner a-9 | Vinyl copolymer (I) | Wax dispersant (I) containing wax (A) and wax dispersion medium (I) | 77 | 0.943 | C.I.Pig.Blue 15:3/C.I.Pig. Yellow 180 | 0.3/0.1 | 72.8 |
| Toner a-10 | Hybrid resin (I): Vinyl copolymer (I) = 7:4 | Wax dispersant containing wax (A) and wax dispersion medium (II) | 79 | 0.940 | C.I.Pig.Blue 15:3/C.I.Pig. Red 122 | 0.6/0.1 | 73.8 |
| Toner a-11 | Hybrid resin (I): Polyester resin (I): Vinyl copolymer (I) = 5:3:2 | Wax dispersant containing wax (A) and wax dispersion medium (I) | 78 | 0.924 | C.I.Pig.Blue 15:3/C.I.Pig. Green 7 | 0.6/0.1 | 80.2 |

TABLE 5

| Toner No. | Binder resin Kind | Wax (Wax duspersant) Kind | Maximal value of maximum heat-adsorption peaks (° C.) | Average circularity | Colorant Kind | Colorant content (parts by mass) | Colorant Ratio of particles having dispersion sizes of 0.05 to 0.5 μm (number %) |
|---|---|---|---|---|---|---|---|
| Toner a-12 | Polyester resin (II) | Wax (D) | 112 | 0.918 | C.I.Pig.Blue 15:3 | 0.4 | 66.9 |
| Toner a-13 | Polyester resin (III) | Wax (E) | 64 | 0.925 | C.I.Pig.Blue 15:3 | 0.4 | 64.2 |
| Toner a-14 | Hybrid resin (I) | Wax (D) | 111 | 0.935 | C.I.Pig.Blue 15:3 | 1.2 | 44.8 |
| Toner b-1 | Hybrid resin (I) | Masterbatch of wax dispersant (I) containing wax (A) and wax dispersion medium (I) | 77 | — | C.I.Pig.Blue 15:3 | 5.0 | 80.5 |
| Toner b-2 | Hybrid resin (I) | Masterbatch of wax dispersant (I) containing wax (A) and wax dispersion medium (I) | 78 | — | C.I.Pig.Blue 15:3 | 8.0 | 79.2 |
| Toner b-3 | Hybrid resin (I) | Masterbatch of wax dispersant (I) containing wax (A) and wax dispersion medium (I) | 77 | — | C.I.Pig.Blue 15:3 | 3.0 | 73.5 |
| Toner b-4 | Hybrid resin (I) | Wax (D) | 112 | — | C.I.Pig.Blue 15:3 | 2.2 | 44.6 |
| Toner b-5 | Hybrid resin (I) | Wax (D) | 113 | — | C.I.Pig.Blue 15:3 | 9.0 | 44.8 |

TABLE 6

| Toner No. | Measurement results of spectral sensitivity distribution of toner in a powder form: Reflectance at 500 nm (%) | Reflectance at 600 nm (%) | L* | Viscoelastic properties of toner (Pa): $G'_{120}$ | $G'_{180}$ | Deformation rate (%): $R_{200}$ | $R_{500}$ |
|---|---|---|---|---|---|---|---|
| Cyan toner a-1 | 62.1 | 16.6 | 63.9 | $2.45 \times 10^4$ | 99 | 54.5 | 72.8 |
| Cyan toner a-2 | 63.1 | 16.5 | 62.8 | $2.08 \times 10^4$ | 88 | 56.7 | 74.3 |
| Cyan toner a-3 | 62.9 | 17.2 | 61.7 | $3.30 \times 10^4$ | 120 | 52.3 | 70.9 |
| Cyan toner a-4 | 61.4 | 15.8 | 60.2 | $2.74 \times 10^4$ | 102 | 54.6 | 71.8 |
| Cyan toner a-5 | 59.3 | 14.8 | 67.3 | $2.38 \times 10^4$ | 96 | 53.8 | 73.6 |
| Cyan toner a-6 | 47.2 | 5.9 | 48.9 | $1.10 \times 10^3$ | 22 | 63.2 | 82.5 |
| Cyan toner a-7 | 61.0 | 15.1 | 61.3 | $6.78 \times 10^4$ | 2,700 | 46.3 | 66.8 |
| Cyan toner a-8 | 58.9 | 13.9 | 58.2 | $1.25 \times 10^4$ | 63 | 58.6 | 77.6 |
| Cyan toner a-9 | 77.3 | 28.2 | 67.5 | $8.59 \times 10^4$ | 3,240 | 45.9 | 65.4 |
| Cyan toner a-10 | 65.2 | 18.8 | 64.9 | $5.24 \times 10^4$ | 1,860 | 52.6 | 72.6 |
| Cyan toner a-11 | 62.2 | 16.4 | 60.9 | $3.08 \times 10^4$ | 106 | 57.9 | 75.8 |
| Cyan toner a-12 | 81.2 | 30.2 | 76.2 | $1.04 \times 10^5$ | 5,090 | 42.3 | 63.8 |
| Cyan toner a-13 | 80.2 | 31.6 | 77.3 | $4.00 \times 10^2$ | 9 | 67.3 | 86.7 |
| Cyan toner a-14 | 41.8 | 4.8 | 42.3 | $2.67 \times 10^4$ | 102 | 58.0 | 79.3 |
| Cyan toner b-1 | 28.3 | 4.3 | 37.9 | $2.82 \times 10^4$ | 123 | 52.6 | 70.8 |
| Cyan toner b-2 | 23.1 | 2.3 | 34.5 | $2.98 \times 10^4$ | 130 | 51.9 | 70.1 |
| Cyan toner b-3 | 44.1 | 4.8 | 43.9 | $1.98 \times 10^4$ | 85 | 59.0 | 78.3 |
| Cyan toner b-4 | 38.2 | 4.2 | 40.9 | $2.58 \times 10^4$ | 103 | 53.9 | 74.6 |
| Cyan toner b-5 | 22.2 | 1.9 | 29.5 | $2.78 \times 10^4$ | 138 | 58.2 | 73.5 |

TABLE 7

| | | Roughness: Optical density of around 0.35 | Optical density of around 0.80 | L* (a) − L* (b) | Fixing temperature range | Transparency on an OHP sheet | c* at L* = 80 |
|---|---|---|---|---|---|---|---|
| Example 1 | Cyan developer a-1 | A (20.2) | — | — | 120–200° C. | A | A |
| Example 2 | Cyan developer a-2 | A (20.5) | — | — | 115–180° C. | A | A |
| Example 3 | Cyan developer a-3 | A (20.5) | — | — | 135–205° C. | A | A |
| Example 4 | Cyan developer a-4 | A (21.3) | — | — | 135–200° C. | A | A |
| Example 5 | Cyan developer a-5 | B (23.1) | — | — | 120–200° C. | B | A |
| Example 6 | Cyan developer a-6 | C (25.4) | — | — | 120–200° C. | C | B |
| Example 7 | Cyan developer a-7 | B (23.3) | — | — | 135–190° C. | B | C |
| Example 8 | Cyan developer a-8 | c (24.2) | — | — | 135–180° C. | C | C |
| Example 9 | Cyan developer a-9 | c (24.1) | — | — | 125–190° C. | C | C |

TABLE 7-continued

| | | Roughness | | | | | |
|---|---|---|---|---|---|---|---|
| | | Optical density of around 0.35 | Optical density of around 0.80 | L* (a) − L* (b) | Fixing temperature range | Transparency on an OHP sheet | c* at L* = 80 |
| Example 10 | Cyan developer a-10 | c (24.3) | — | — | 125–190° C. | B | B |
| Example 11 | Cyan developer a-11 | c (24.1) | — | — | 130–190° C. | C | C |
| Example 12 | Cyan developer a-1/b-1 | — | A (30.5) | 26.0 | 135–185° C. | A | B |
| Example 13 | Cyan developer a-2/b-1 | — | A (30.5) | 24.9 | 125–170° C. | A | B |
| Example 14 | Cyan developer a-3/b-1 | — | A (30.6) | 23.6 | 145–195° C. | A | B |
| Example 15 | Cyan developer a-4/b-1 | — | A (31.4) | 22.3 | 145–200° C. | A | A |
| Example 16 | Cyan developer a-5/b-1 | — | B (33.8) | 29.4 | 130–190° C. | B | B |
| Example 17 | Cyan developer a-6/b-1 | — | C (35.4) | 11.0 | 130–190° C. | C | B |
| Example 18 | Cyan developer a-7/b-1 | — | B (33.2) | 23.4 | 145–180° C. | B | C |
| Example 19 | Cyan developer a-9/b-1 | — | C (34.2) | 20.3 | 145–170° C. | C | C |
| Example 20 | Cyan developer a-10/b-1 | — | C (34.1) | 29.6 | 135–180° C. | C | C |
| Example 21 | Cyan developer a-11/b-1 | — | C (34.5) | 27.0 | 135–180° C. | C | B |
| Example 22 | Cyan developer a-1/b-2 | — | C (34.1) | 26.0 | 140–180° C. | C | C |
| Example 23 | Cyan developer a-1/b-3 | — | B (33.1) | 29.4 | 135–185° C. | B | B |
| Example 24 | Cyan developer a-1/b-3 | — | B (33.9) | 20.0 | 130–185° C. | B | B |
| Example 25 | Cyan developer a-8/b-2 | — | C (35.2) | 23.7 | 130–180° C. | C | C |
| Example 26 | Cyan developer a-1/b-1 | — | A (31.8) | 29.3 | 135–185° C. | B | B |

TABLE 8

| | | Roughness | | | | | |
|---|---|---|---|---|---|---|---|
| | | Optical density of around 0.35 | Optical density of around 0.80 | L* (a) − L* (b) | Fixing temperature range | Transparency on an OHP sheet | c* at L* = 80 |
| Comparative Example 1 | Cyan developer a-12 | D (27.2) | — | — | 155–170° C. | D | D |
| Comparative Example 2 | Cyan developer a-13 | E (33.5) | — | — | 130–175° C. | B | C |
| Comparative Example 3 | Cyan developer a-14 | E (34.8) | — | — | 160–175° C. | D | D |
| Comparative Example 4 | Cyan developer a-4/b-4 | — | D (37.5) | 19.3 | 160–175° C. | C | C |
| Comparative Example 5 | Cyan developer a-1/b-5 | — | E (38.1) | 34.4 | 135–180° C. | E | C |
| Comparative Example 6 | Cyan developer a-6/b-3 | — | E (38.2) | 3.0 | 165–175° C. | E | E |

What is claimed is:

1. A cyan toner comprising cyan toner particles comprising at least a binder resin, a colorant, and a wax, wherein:

the cyan toner has one or plural heat-absorption peaks in a temperature range of 30 to 200° C. in a heat-absorption curve obtained by using a differential scanning calorimeter;

a maximal value of a maximum heat-absorption peak temperature is in the range of 65 to 105° C.; and the cyan toner in a powder form has a reflectance of 45 to 80% at a wavelength of 500 nm, a reflectance of 5 to 30% at a wavelength of 600 nm, and a brightness L* of 45 to 75, when measured by spectroscopic analysis.

2. The cyan toner according to claim 1, wherein the wax is a hydrocarbon wax.

3. The cyan toner according to claim 1, wherein the colorant in the cyan toner particles contains 70% by number or more of colorant particles having particle diameters of 0.05 to 0.5 μm with respect to the total colorant.

4. The cyan toner according to claim 1, wherein the binder resin comprises, as a main component, a resin selected from the group consisting of:

(a) a polyester resin;

(b) a hybrid resin comprising a polyester unit and a vinyl copolymer unit;

(c) a mixture of the hybrid resin and a vinyl copolymer;

(d) a mixture of the hybrid resin and a polyester resin;

(e) a mixture of a polyester resin and a vinyl copolymer; and (f) a mixture of a polyester resin, the hybrid resin and a vinyl copolymer.

5. The cyan toner according to claim 1, wherein the cyan toner particles further comprises a wax dispersion medium, which is a reaction product of a vinyl polymer and polyolefin.

6. The cyan toner according to claim 5, wherein:

the wax dispersion medium is a product of a graft polymerization of a polymer or a copolymer, each of which is synthesized by using one or more kinds of monomers selected from the group consisting of a styrene monomer, a nitrogen-containing vinyl monomer, an acrylic monomer and a methacrylic monomer, and a polyolefin; and a maximal value of a maximum heat-absorption peak temperature of the polyolefin is in the range of 80 to 140° C. in a heat-absorption curve measured during a course of a temperature increase using a differential scanning calorimeter (DSC).

7. The cyan toner according to claim 5, wherein the wax dispersion medium has a weight average molecular weight (Mw) in the range of 5,000 to 100,000, a number average molecular weight (Mn) in the range of 1,500 to 15,000, and a ratio (Mw/Mn) of the weight average molecular weight (Mw) to the number average molecular weight (Mn) being 2 to 40 in a molecular weight distribution measured by gel permeation chromatography (GPC).

8. The cyan toner according to claim 1, further comprising a metal compound of aromatic carboxylic acid.

9. The cyan toner according to claim 1, wherein an average circularity of the cyan toner of which particles have equivalent circle diameter of 2 μm or larger, is in the range of 0.920 to 0.945.

10. The cyan toner according to claim 1, wherein an elastic modulus ($G'_{120}$) at 120° C. of the cyan toner is in the range of $5\times10^2$ to $1\times10^5$ [Pa] and an elastic modulus ($G'_{180}$) at 180° C. of the cyan toner is in the range of 10 to $5\times10^3$ [Pa].

11. The cyan toner according to claim 1, wherein a sample of the cyan toner, which is obtained by pressure-molding the toner into pellets, has a deformation rate ($R_{200}$) being 45 to, 65% when compressed at 120° C. and $4.0\times10^3$ Pa and a deformation rate ($R_{500}$) being 65 to 85% when compressed at 120° C. and $1.0\times10^4$ Pa.

12. The cyan toner according to claim 1, wherein the cyan toner particles are produced by melt-kneading at least a binder resin, a colorant, and a wax; cooling the kneaded product; and pulverizing the cooled product.

13. The cyan toner according to claim 1, wherein the cyan toner particles are produced by further classifying after pulverizing the kneaded product.

14. The cyan toner according to claim 1, wherein the colorant is a mixture of C.I. Pigment Blue 15:3 and C.I. Pigment Green 7.

15. The cyan toner according to claim 1, wherein the cyan toner is a pale cyan toner.

16. A method for forming an image, comprising:

forming a first electrostatic charge image on an electrostatic charge image bearing member, forming a first cyan toner image by developing the first electrostatic charge image using a first cyan toner, and transferring the first cyan toner image to a transfer material through or without an intermediate transfer material;

forming a second electrostatic charge image on the electrostatic charge image bearing member, forming a second cyan toner image by developing the second electrostatic charge image using a second cyan toner, and transferring the second cyan toner image to a transfer material through or without the intermediate transfer material; and forming a fixed image on the transfer material by heat-pressure-fixing the first cyan toner image and the second cyan toner image on the transfer material, wherein:

the first cyan toner is one of a pale cyan toner and a deep cyan toner;

the second cyan toner is the other of the pale cyan toner and the deep cyan toner;

the pale cyan toner comprises cyan toner particles comprising at least a binder resin, a colorant, and a wax, wherein: the pale cyan toner has one or plural heat-absorption peaks in a temperature range of 30 to 200° C. in a heat-absorption curve obtained by using a differential scanning calorimeter; a maximal value of a maximum heat-absorption peak temperature is in the range of 65 to 105° C.; and the pale cyan toner has a reflectance of 45 to 80% at a wavelength of 500 nm, a reflectance of 5 to 30% at a wavelength of 600 nm, and a brightness L* of 45 to 75, when measured by using the cyan toner in a powder form by spectroscopic analysis; and the deep toner is a cyan toner having a brightness L* value smaller than that of the pale toner.

17. The method for forming an image according to claim 16, wherein the cyan toner satisfies the following equation, $$10 \leqq L^*(a) - L^*(b) \leqq 30$$

(wherein, L* (a) represents a brightness L* of the pale cyan toner and L* (b) represents a brightness L* of the deep cyan toner).

18. A method for forming an image, comprising forming a first electrostatic charge image on an electrostatic charge image bearing member, forming a first toner image by developing the first electrostatic charge image using a first toner selected from the group consisting of a magenta toner, a yellow toner, a pale cyan toner, a deep cyan toner, and a black toner, and transferring the first toner image to a transfer material through or without an intermediate transfer material;

forming a second electrostatic charge image on the electrostatic charge image bearing member, forming a second toner image by developing the second electrostatic charge image using a second toner selected from the group consisting of a magenta toner, a yellow toner, a pale cyan toner, a deep cyan toner, and a black toner, excluding the first toner, and transferring the second toner image to a transfer material through or without the intermediate transfer material;

forming a third electrostatic charge image on the electrostatic charge image bearing member, forming a third toner image by developing the third electrostatic charge image using a third toner selected from the group consisting of a magenta toner, a yellow toner, a pale cyan toner, a deep cyan toner, and a black toner excluding the first toner and the second toner, and transferring the third toner image to a transfer material through or without the intermediate transfer material;

forming a fourth electrostatic charge image on the electrostatic charge image bearing member, forming a fourth toner image by developing the fourth electrostatic charge image using a fourth toner selected from the group consisting of a magenta toner, a yellow toner, a pale cyan toner, a deep cyan toner, and a black toner, excluding the first to the third toners, and transferring the fourth toner image to a transfer material through or without the intermediate transfer material;

forming a fifth electrostatic charge image on the electrostatic charge image bearing member, forming a fifth toner image by developing the fifth electrostatic charge image using a fifth toner selected from the group consisting of a magenta toner, a yellow toner, a pale cyan toner, a deep cyan toner, and a black toner, excluding the first to the fourth toners, and transferring the fifth toner image to a transfer material through or without the intermediate transfer material, wherein a magenta toner image, a yellow toner image, a pale cyan toner image, a deep cyan toner image and a black toner image are transferred to the transfer material; and forming a fixed image on the transfer material by heat-pressure-fixing the magenta toner image, the yellow toner image, the pale cyan toner image, the deep cyan toner image, and the black toner image, which are carried on the transfer material wherein:

the pale cyan toner comprises cyan toner particles comprising at least a binder resin, a colorant, and a wax, wherein: the pale cyan toner has one or plural heat-absorption peaks in a temperature range of 30 to 200° C. in a heat-absorption curve obtained by using a differential scanning calorimeter; a maximal value of a maximum heat-absorption peak temperature is in the range of 65 to 105° C.; and the pale cyan toner has a reflectance of 45 to 80% at a wavelength of 500 nm, a reflectance of 5 to 30% at a wavelength of 600 nm, and a brightness L* of 45 to 75, when measured by using the cyan toner in a powder form by spectroscopic analysis; and the deep toner is a cyan toner having a brightness L* value smaller than that of the pale toner.

19. The method for forming an image according to claim 18, wherein the cyan toner satisfies the following equation, $$10 \leqq L^*(a) - L^*(b) \leqq 30$$

(wherein, L* (a) represents a brightness L* of the pale cyan toner and L* (b) represents a brightness L* of the deep cyan toner).

20. A method for forming an image, comprising:

forming a first electrostatic charge image on an electrostatic charge image bearing member, forming a first cyan toner image by developing the first electrostatic charge image using a first cyan toner, and transferring the first cyan toner image to a transfer material through or without an intermediate transfer material;

forming a second electrostatic charge image on the electrostatic charge image bearing member, forming a second cyan toner image by developing the second electrostatic charge image using a second cyan toner, and transferring the second cyan toner image to a transfer material through or without the intermediate transfer material; and forming a fixed image on the transfer material by heat-pressure-fixing the first cyan toner image and the second cyan toner image on-the transfer material, wherein:

the first cyan toner is one of a pale cyan toner and a deep cyan toner having a brightness L* value smaller than that of the pale toner;

the second cyan toner is the other of the pale cyan toner and the deep cyan toner; and wherein the pale cyan toner is any one of the cyan toners according to claims 2 to 14.

21. A method for forming an image, comprising forming a first electrostatic charge image on an electrostatic charge image bearing member, forming a first toner image by developing the first electrostatic charge image using a first toner selected from the group consisting of a magenta toner, a yellow toner, a pale cyan toner, a deep cyan toner, and a black toner, and transferring the first toner image to a transfer material through or without an intermediate transfer material;

forming a second electrostatic charge image on the electrostatic charge image bearing member, forming a second toner image by developing the second electrostatic charge image using a second toner selected from the group consisting of a magenta toner, a yellow toner, a pale cyan toner, a deep cyan toner, and a black toner, excluding the first toner, and transferring the second toner image to a transfer material through or without the intermediate transfer material;

forming a third electrostatic charge image on the electrostatic charge image bearing member, forming a third toner image by developing the third electrostatic charge image using a third toner selected from the group consisting of a magenta toner, a yellow toner, a pale cyan toner, a deep cyan toner, and a black toner excluding the first toner and the second toner, and transferring the third toner image to a transfer material through or without the intermediate transfer material;

forming a fourth electrostatic charge image on the electrostatic charge image bearing member, forming a fourth toner image by developing the fourth electrostatic charge image using a fourth toner selected from the group consisting of a magenta toner, a yellow toner, a pale cyan toner, a deep cyan toner, and a black toner, excluding the first to the third toners, and transferring the fourth toner image to a transfer material through or without the intermediate transfer material;

forming a fifth electrostatic charge image on the electrostatic charge image bearing member, forming a fifth toner image by developing the fifth electrostatic charge image using a fifth toner selected from the group consisting of a magenta toner, a yellow toner, a pale cyan toner, a deep cyan toner, and a black toner, excluding the first to the fourth toners, and transferring the fifth toner image to a transfer material through or without the intermediate transfer material, wherein a magenta toner image, a yellow toner image, a pale cyan toner image, a deep cyan toner image and a black toner image are transferred to the transfer material; and forming a fixed image on the transfer material by heat-pressure-fixing the magenta toner image, the yellow toner image, the pale cyan toner image, the deep cyan toner image, and the black toner image, which are carried on the transfer material wherein the deep toner is a cyan toner having a brightness L* value smaller than that of the pale toner and wherein the pale cyan toner is any one of the cyan toners according to claims 2–14.

* * * * *

UNITED STATES PATENT AND TRADEMARK OFFICE

CERTIFICATE OF CORRECTION

PATENT NO. : 7,138,213 B2
APPLICATION NO. : 10/793965
DATED : November 21, 2006
INVENTOR(S) : Takayuki Itakura et al.

It is certified that error appears in the above-identified patent and that said Letters Patent is hereby corrected as shown below:

ON THE TITLE PAGE, ITEM [56] REFERENCES CITED:

Foreign Patent Documents, "06-67468 3/1999" should read --06-67468 3/1994--.

COLUMN 12:

Line 15, "(GPC)" should read --(GPC).--; and
Line 64, "maybe" should read --may be--.

COLUMN 16:

Line 1, "compounds-bonded" should read --compounds bonded--.

COLUMN 19:

Line 17, "agent;" should read --agent,--.

COLUMN 20:

Line 55, "maybe" should read --may be--.

COLUMN 24:

Line 12, "(I)" should read --(I).--.

COLUMN 25:

Line 3, "aperylene" should read --a perylene--; and
Line 4, "as quarylium" should read --a squarylium--.

COLUMN 26:

Line 3, "centerline" should read --center line--.

COLUMN 31:

Line 18, "wise)" should read --wise).--.

UNITED STATES PATENT AND TRADEMARK OFFICE

CERTIFICATE OF CORRECTION

PATENT NO. : 7,138,213 B2
APPLICATION NO. : 10/793965
DATED : November 21, 2006
INVENTOR(S) : Takayuki Itakura et al.

It is certified that error appears in the above-identified patent and that said Letters Patent is hereby corrected as shown below:

COLUMN 35:

Line 10, ""Tetoral 150"" should read --"Tetora 150"--.

COLUMN 38:

Table 1, "(Production of masterbatch of wax dispersant)" should be deleted;
Line 43, "Next," should read --(Production of Masterbatch of Wax Dispersant)
¶ Next,--.

COLUMN 39:

Line 21, "invention." should read --invention.
¶ Wax dispersion medium (I) 50% by mass
¶ Wax (A)-- 50% by mass--.

COLUMN 45:

Line 12, "(deep)" should read --(deep).--.

COLUMN 48:

Line 30, "in-the" should read --in the--.

COLUMN 56:

Line 3, "to," should read --to--.

UNITED STATES PATENT AND TRADEMARK OFFICE

CERTIFICATE OF CORRECTION

PATENT NO. : 7,138,213 B2
APPLICATION NO. : 10/793965
DATED : November 21, 2006
INVENTOR(S) : Takayuki Itakura et al.

It is certified that error appears in the above-identified patent and that said Letters Patent is hereby corrected as shown below:

COLUMN 58:

Line 21, "on-the" should read --on the--.

Signed and Sealed this

Eleventh Day of December, 2007

JON W. DUDAS
*Director of the United States Patent and Trademark Office*